US009849601B2

(12) United States Patent
Anayama et al.

(10) Patent No.: US 9,849,601 B2
(45) Date of Patent: Dec. 26, 2017

(54) CUTTING APPARATUS AND PRINTING APPARATUS

(71) Applicant: CANON KABUSHIKI KAISHA, Tokyo (JP)

(72) Inventors: Daiki Anayama, Yokohama (JP); Takakazu Ohashi, Kawasaki (JP); Ryohei Maruyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 127 days.

(21) Appl. No.: 14/847,367

(22) Filed: Sep. 8, 2015

(65) Prior Publication Data

US 2016/0067988 A1 Mar. 10, 2016

(30) Foreign Application Priority Data

Sep. 9, 2014 (JP) ..... 2014-183375

(51) Int. Cl.
*B26D 5/08* (2006.01)
*B26D 1/24* (2006.01)
*B41J 11/70* (2006.01)

(52) U.S. Cl.
CPC ..... *B26D 5/08* (2013.01); *B26D 1/245* (2013.01); *B41J 11/706* (2013.01)

(58) Field of Classification Search
CPC ..... B41J 11/66; B41J 11/663; B41J 11/666; B41J 11/68; B41J 11/70; B41J 11/703; B41J 11/706; H04N 1/00567; H04N 1/00676; H04N 1/00679
USPC .... 347/16, 104; 400/621, 621.1, 621.2, 583, 400/642
See application file for complete search history.

(56) References Cited

U.S. PATENT DOCUMENTS

2013/0202342 A1* 8/2013 Kosuge ..... B41J 11/66 400/621

FOREIGN PATENT DOCUMENTS

JP H6-155372 A 6/1994

* cited by examiner

*Primary Examiner* — Lisa M Solomon
(74) *Attorney, Agent, or Firm* — Fitzpatrick, Cella, Harper & Scinto

(57) ABSTRACT

A cutting apparatus comprising: a cutting unit including a first blade member and a second blade member that cooperates with the first blade member in cutting an object, configured to cut the object by relatively moving the object and at least one of the first blade member and the second blade member to each other to cut the object; and a changing unit configured to change a pressing force between the first blade member and the second blade member during an operation of cutting the object; wherein the changing unit sets the pressing force during the initial cutting operation from a time when cutting of the object is started until the object has been cut by a predetermined length higher than the pressing force during the subsequent cutting operation.

11 Claims, 18 Drawing Sheets

PRESSING FORCE: 3.92 N

PRESSING FORCE: 11.76 N

CUTTING APPARATUS AND PRINTING APPARATUS

BACKGROUND OF THE INVENTION

Field of the Invention

The present invention relates to a cutting apparatus that cuts a cut medium and a printing apparatus with the cutting apparatus mounted therein.

Description of the Related Art

A cutting apparatus that cuts a cut medium using a pair of blades is conventionally known. The cutting apparatus is mounted in, for example, a printing apparatus that cuts a rolled print medium, and is used as a device that cuts and separates a print medium with image data printed thereon into pages.

A configuration is known in which one of the blades is brought into contact with the other blade under pressure to prevent inappropriate cutting.

However, when cut media with different cutting resistances are cut, the configuration disadvantageously fails to deal with the respective cutting resistances, resulting in inappropriate cutting.

To solve this problem, Japanese Patent Laid-Open No. H06-155372 (1994) discloses a configuration in which a rotary blade fixing member is moved to change the spring pressure of a spring that biases the rotary blade to change the pressing force of the blade according to the cutting resistance, thus improving the cutting performance.

However, when cutting is continued with the increased pressing force, cutting edges are significantly worn off, and the lives of the blades are shortened. When cutting is carried out with the pressing force of the blade increased to enhance the cutting performance as in Japanese Patent Laid-Open No. H06-155372(1994), the blades appropriately bite into the cut medium at the start of the cutting, preventing inappropriate cutting. However, the blades are significantly worn off during the cutting, and the lives of the blades are shortened.

SUMMARY OF THE INVENTION

Therefore, the present invention provides a cutting apparatus and a printing apparatus that enhance cutting performance at the start of cutting, while suppressing wear of cutting edges.

Thus, a cutting apparatus comprising: a cutting unit including a first blade member and a second blade member that cooperates with the first blade member in cutting an object, configured to cut the object by relatively moving the object and at least one of the first blade member and the second blade member to each other to cut the object; and a changing unit configured to change a pressing force between the first blade member and the second blade member during an operation of cutting the object; wherein the changing unit sets the pressing force during the initial cutting operation from a time when cutting of the object is started until the object has been cut by a predetermined length higher than the pressing force during the subsequent cutting operation.

Further features of the present invention will become apparent from the following description of exemplary embodiments (with reference to the attached drawings).

DESCRIPTION OF THE EMBODIMENTS

First Embodiment

Figure 1:
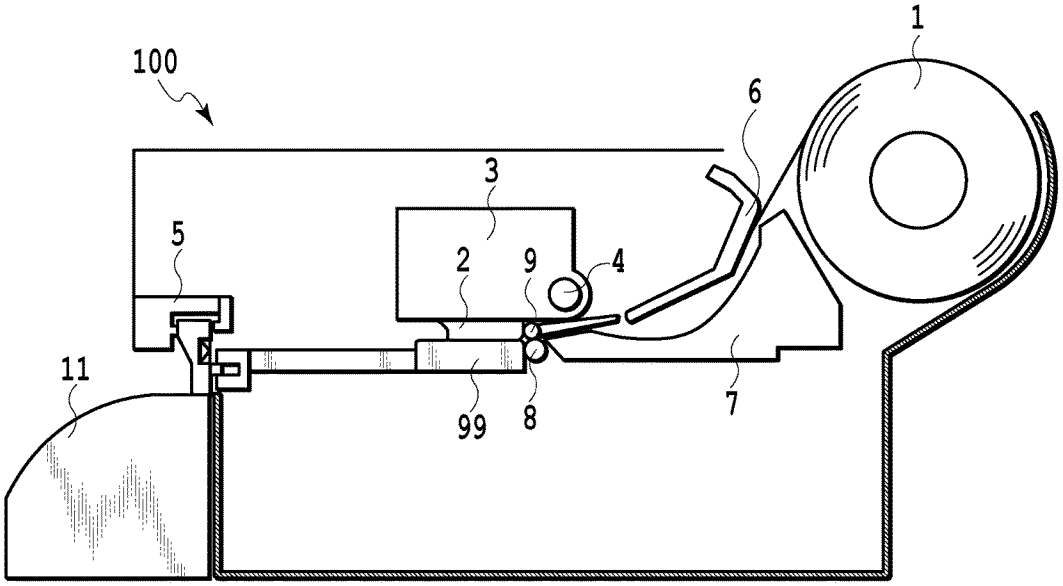
FIG. 1 is a schematic sectional view depicting an ink jet printing apparatus according to a first embodiment.

A first embodiment of the present invention will be described with reference to the drawings. The same reference numerals denote the same or corresponding components throughout the drawings.

FIG. 1 is a schematic sectional view depicting an ink jet printing apparatus according to the first embodiment of the present invention. With reference to FIG. 1, a general configuration of the ink jet printing apparatus according to the present embodiment will be described. Rolled paper 1 held in an ink jet printing apparatus 100 is fed downstream through a conveying path including an upper guide 6 and a lower guide 7. When a leading end of the rolled paper 1 reaches a nip portion between a conveying roller 8 and a pinch roller 9, the rolled paper 1 is sandwiched between the conveying roller 8 and the pinch roller 9 and conveyed onto a platen 99 (image printing section) arranged opposite to a print head 2.

The image printing section includes the print head 2, a carriage 3 on which the print head 2 is mounted, and the platen 99 arranged opposite to the print head 2. The carriage 3 is slidably supported by the main body of the ink jet printing apparatus 100 along a carriage shaft 4 and a guide rail (not depicted in the drawings) arranged parallel to each other. The carriage 3 is configured to be able to reciprocate. Printing is performed by reciprocating the carriage 3 with the print head 2 mounted thereon and allowing the print head 2 to eject ink onto the rolled paper 1.

In the image printing section, when an image is printed by moving the carriage 3 forward or backward to scan one line, the conveying roller 8 and the pinch roller 9 feed the rolled paper 1 by a predetermined pitch in a conveying direction. The carriage 3 is then moved again to print the next line of the image. A printed portion of the rolled paper 1 is conveyed toward a sheet discharging guide 11. Such an operation is repeated to print an image on the rolled paper 1. When the image printing ends, the rolled paper 1 is conveyed to a predetermined cutting position where the rolled paper 1 is cut using a cutting apparatus 5. The cut rolled paper 1 is discharged to the exterior of the ink jet printing apparatus 100 through the sheet discharging guide 11.

Figure 2:
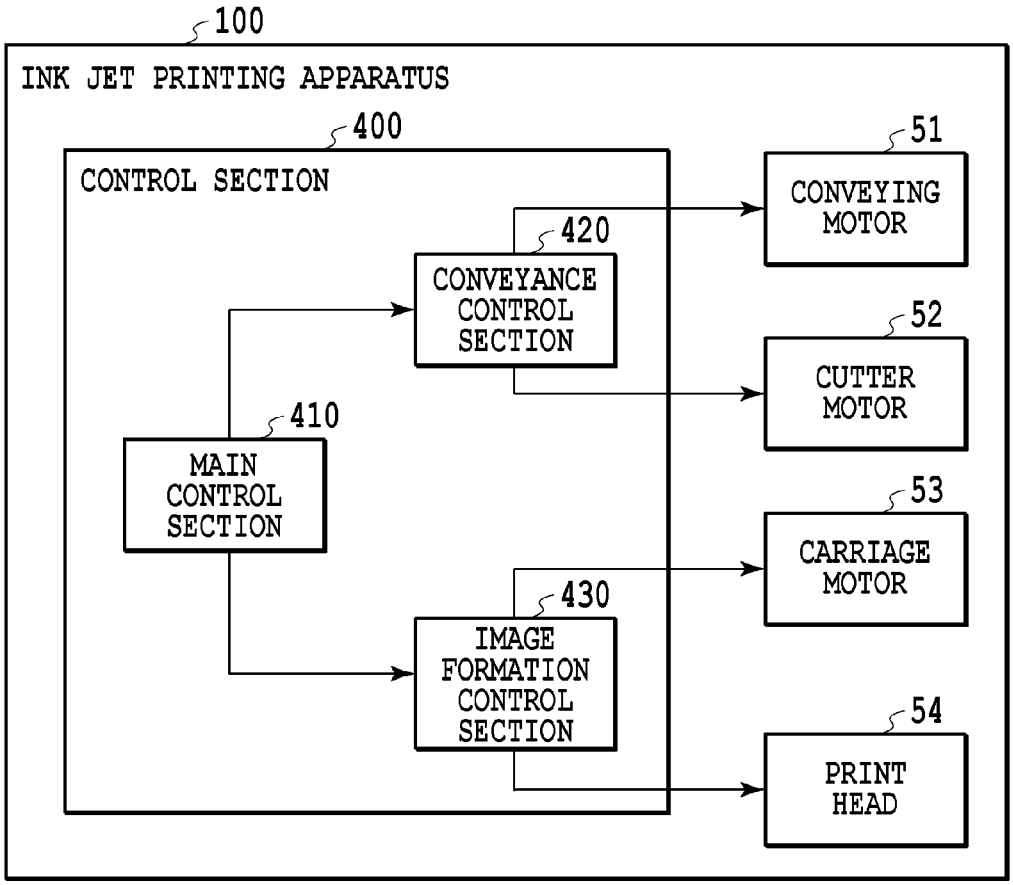
FIG. 2 is a schematic block diagram depicting an embodiment of a control configuration.

FIG. 2 is a schematic block diagram depicting an embodiment of a control configuration of the ink jet printing apparatus 100. With reference to FIG. 2, the control configuration according to the present invention will be described in brief. A control section 400 is provided on the ink jet printing apparatus 100. The control section 400 achieves control of a conveying motor 51, a cutter motor 52, a carriage motor 53, and a print head 54.

The control section 400 also includes a CPU, a ROM, a RAM, and a motor driver not depicted in the drawings, and further includes a main control section 410, a conveyance control section 420, and an image formation control section 430. The main control section 410 gives instructions to the conveyance control section 420 and the image formation control section 430. Based on a determination by the main control section 410, the conveyance control section 420 drives the conveying motor 51 to operate conveying devices, such as the conveying roller 8, to convey the rolled paper 1, and drives the cutter motor 52 to cut the rolled paper 1. The image formation control section 430 allows the carriage motor 53 and the print head 2 to cooperate with each other in forming an image at an appropriate position on the rolled paper 1.

Figure 3:
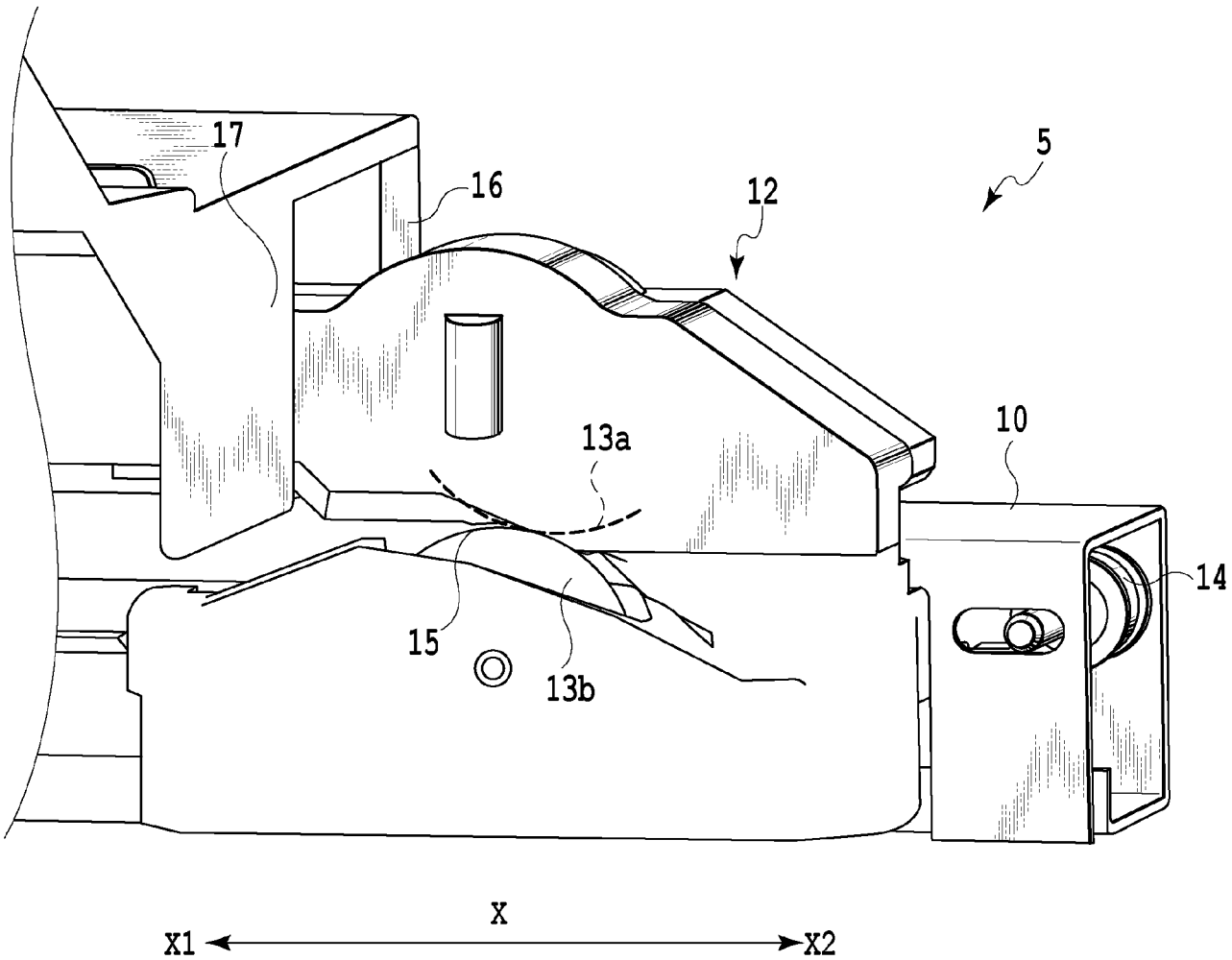
FIG. 3 is a perspective view of a cutting apparatus according to the first embodiment.
Figure 4:
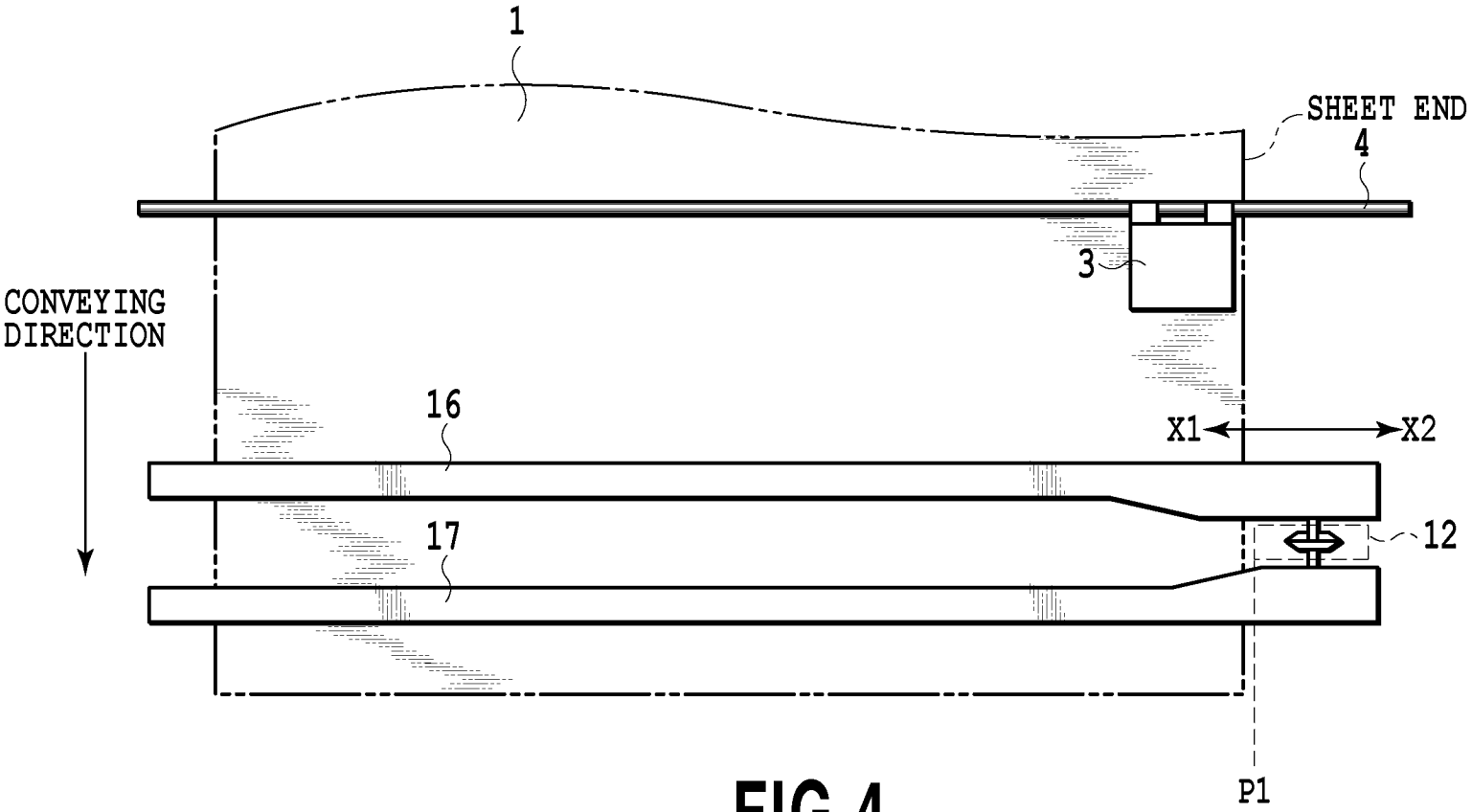
FIG. 4 is a top view of an ink jet printing apparatus according to the first embodiment.
Figure 5:
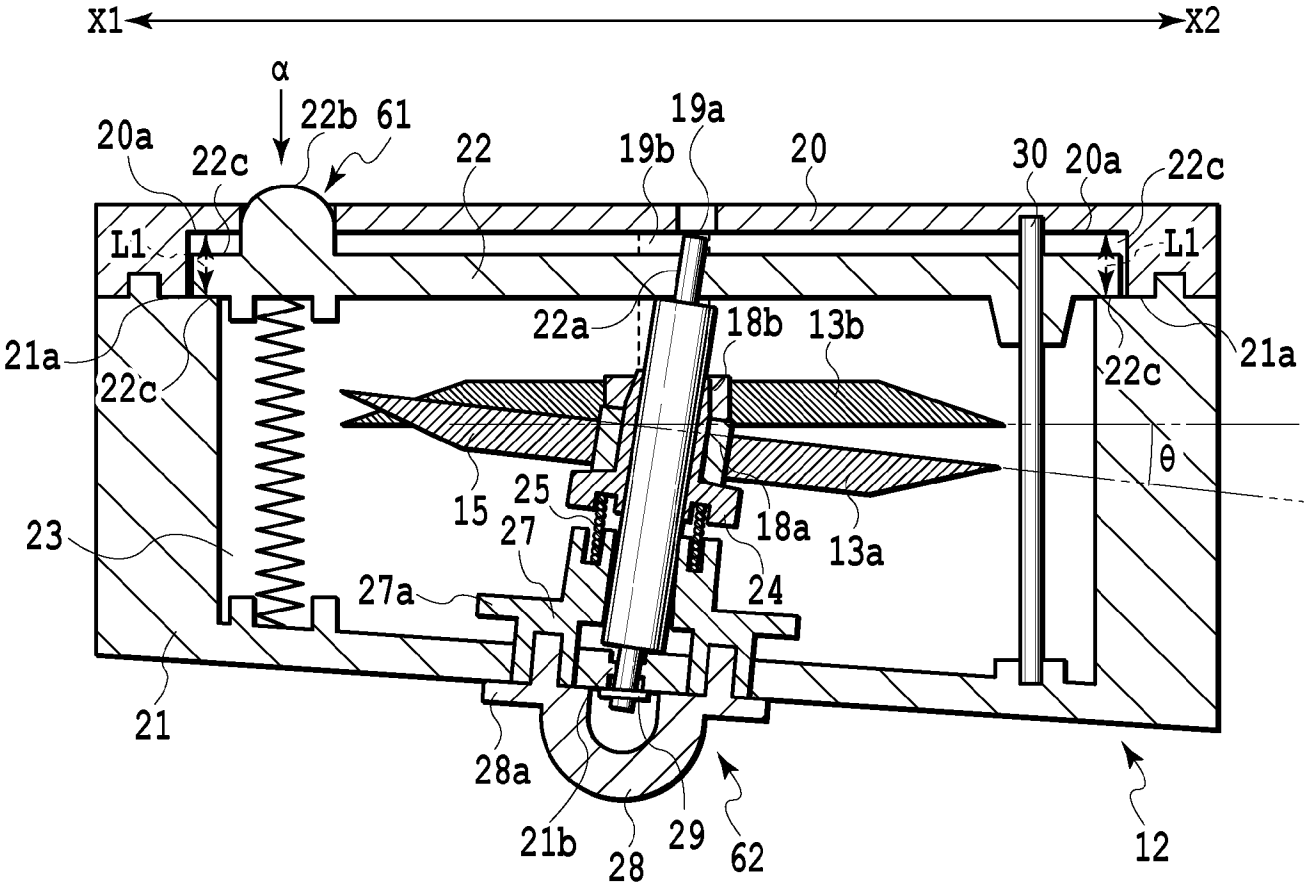
FIG. 5 is a schematic sectional view of a cutter unit according to the first embodiment as seen from above.
Figure 6:
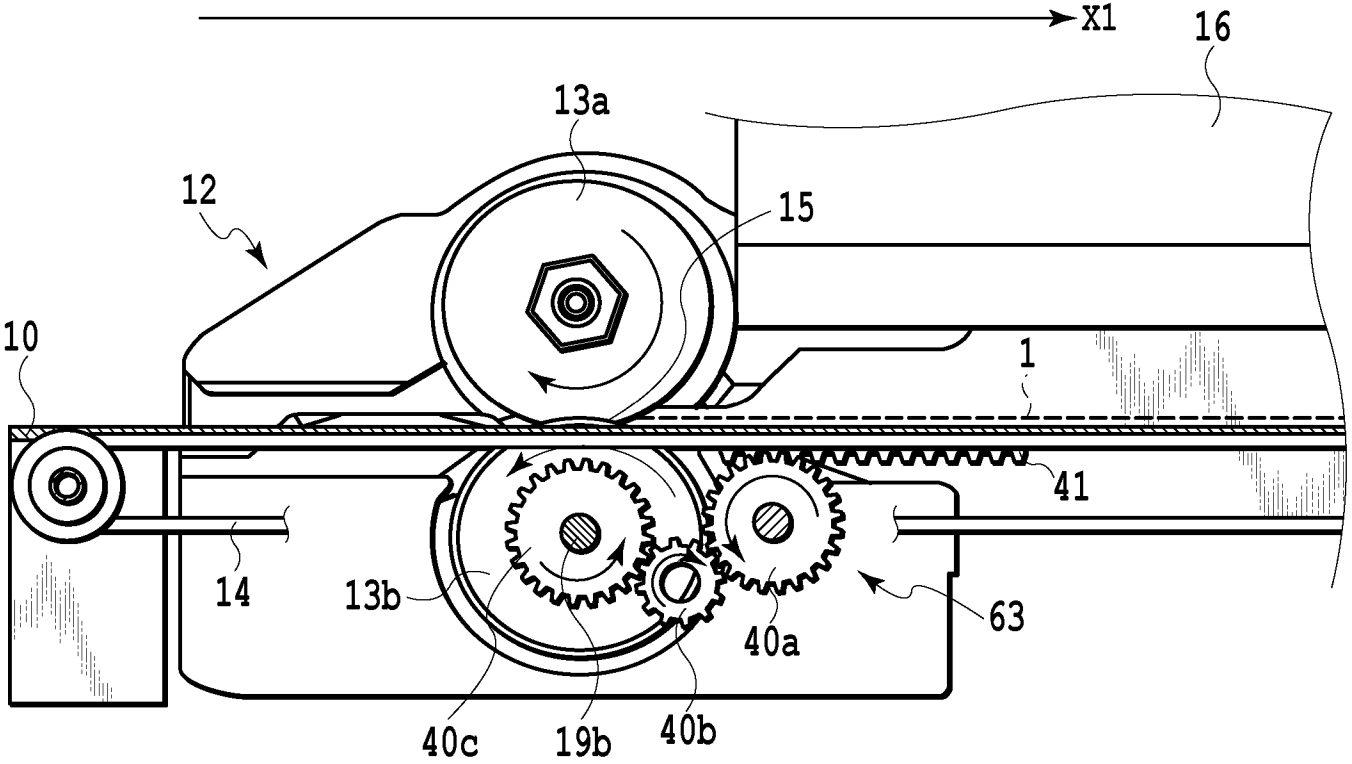
FIG. 6 is a schematic sectional view of the cutter unit according to the first embodiment as seen from behind.

FIG. 3 is a perspective view depicting the cutting apparatus according to the present invention. FIG. 4 is a top view of the ink jet printing apparatus according to the present invention. FIG. 5 is a schematic sectional view of a cutter unit according to the present invention as seen from above. FIG. 6 is a schematic sectional view of the cutter unit according to the present invention as seen from behind, depicting a rotary-blade rotating device that rotates a lower movable blade when the cutter unit is in a cutting start point position.

Now, the cutting apparatus according to the present invention will be described with reference to FIG. 3, FIG. 4, FIG. 5, and FIG. 6.

A cutting apparatus 5 has a cutter unit 12, a guide rail 10, and a belt 14. The guide rail 10 is configured to guide the cutter unit 12 in a direction orthogonal to the conveying direction of the rolled paper 1. The cutter unit 12 can be reciprocated along the guide rail 10 in the direction X1 and the direction X2 of arrow X by a driving force transmitted from the cutter motor 52, which is a driving section, via the belt 14. The cutter unit 12 stands by in a standby position P1 (see FIG. 4) where the cutter unit 12 is away from an end of the rolled paper 1 while image formation is being performed on the rolled paper 1. When the rolled paper 1 is cut, the cutter unit 12 moves in the cutting direction X1, which is the direction for cutting, from the standby position P1 to cut the rolled paper 1 (object). After the rolled paper 1 is cut, the cutter unit 12 moves in the direction X2 without performing a cutting operation and stands by in the standby position P1 until the next cutting operation.

As depicted in FIG. 5 and FIG. 6, the cutter unit 12 includes an upper movable blade 13*a*, a lower movable blade 13*b*, a crossing angle changing device 61, a pressing force changing device 62, and a rotary-blade rotating device 63. The upper movable blade 13*a* is a rotatable disc-like (circular) blade disposed above a surface of the rolled paper 1 on which an image is formed and including a peripheral blade. The lower movable blade 13*b* is a rotatable disc-like circular blade disposed below a back surface of the rolled paper 1, that is opposite to the surface on which the image is formed, and includes a peripheral blade. The lower movable blade 13*b* cooperates with the upper movable blade 13*a* in cutting the object. The lower movable blade 13*b* has a surface substantially parallel to the cutting direction. On the other hand, the blade of the upper movable blade 13*a* has a surface inclined to the cutting direction and subtends a predetermined angle θ (crossing angle θ) to the cutting direction X1.

Specifically, a standby position P1 side of the upper movable blade 13*a* is disposed on a downstream side with respect to the lower movable blade 13*b* in the conveying direction of the rolled paper 1. The side of the upper movable blade 13*a* opposite to the standby position P1 side is partly disposed on an upstream side with respect to the lower movable blade 13*b* in the conveying direction of the rolled paper 1. The upper movable blade 13*a* is pressed against the lower movable blade 13*b* at a predetermined angle θ (crossing angle θ) to the cutting direction X1. The upper movable blade 13*a* thus comes into point contact with the lower movable blade 13*b* and is rotatably held. In other words, the upper movable blade 13*a* is pressed against the lower movable blade 13*b* at the predetermined angle θ (crossing angle θ). The contact point between the upper movable blade 13*a* and the lower movable blade 13*b* corresponds to a cutting point 15. The upper movable blade 13*a* and the lower movable blade 13*b* rotate while in contact with each other at the cutting point 15. Consequently, the cutter unit 12 moves in the cutting direction X1 with the rolled paper 1 held, cutting the rolled paper 1.

When the rolled paper 1 is cut, the cutter unit 12 moves in the cutting direction X1 to rotate the upper movable blade 13*a* and the lower movable blade 13*b* in a direction in which the rolled paper 1 is drawn into the cutting point 15, and moves in the direction X1 as depicted in FIG. 6.

A bearing 18*a* and a bearing 18*b* are fixed with an adhesive or the like to the vicinities of the centers of rotation of the upper movable blade 13*a* and the lower movable blade 13*b*, respectively. The bearings reduce rotating loads on the upper movable blade 13*a* and the lower movable blade 13*b*. The upper movable blade 13*a* and the lower movable blade 13*b* rotate around an upper movable blade rotating shaft 19*a* and a lower movable blade rotating shaft 19*b*, respectively, via the bearings.

As depicted in FIG. 5, the crossing angle changing device 61 includes an upstream side holding portion 20, a downstream side holding portion 21, a slide member 22, a slide pressing spring 23, and a slide rail shaft 30. The crossing angle changing device 61 allows the crossing angle θ of the upper movable blade 13*a* to be changed. A groove portion 22*a* is formed in the slide member 22 to pivotally support one side of the upper movable blade rotating shaft 19*a*. A groove portion 21*b* is formed in the downstream side holding portion 21 to pivotally support the other side of the upper movable blade rotating shaft 19*a*.

That is, the groove portion 22*a* formed in the slide member 22 and the groove portion 21*b* formed in the downstream side holding portion 21 pivotally support the upper movable blade rotating shaft 19*a*. The groove portion 22*a* in the slide member 22 is arranged behind and at a predetermined distance from the groove portion 21*b* in the downstream side holding portion 21 such that the upper movable blade rotating shaft 19*a* is inclined to a direction orthogonal to the cutting direction X1. Thus, the upper movable blade 13*a* is inclined at the predetermined angle (crossing angle) θ to the cutting direction X1. That is, the upper movable blade rotating shaft 19*a*, the groove portion 21*b* in the downstream side holding portion 21, and the groove portion 22*a* in the slide member 22 set the crossing angle θ.

A thrust suppressing portion 29 is attached to an end of the downstream side holding portion 21 of the upper movable blade rotating shaft 19*a* to prevent the upper movable blade rotating shaft 19*a* from slipping out from the downstream side holding portion 21. The slide rail shaft 30 is pivotally supported in a direction substantially orthogonal to the cutting direction X1 by the upstream side holding portion 20 and the downstream side holding portion 21. The slide member 22 includes an abutting contact portion 22*c* arranged in a slide area L1 sandwiched between a retaining portion 20*a* of the upstream side holding portion 20 and a sliding suppressing portion 21*a* of the downstream side holding portion 21. In the above-described arrangement, the slide member 22 can slide on the slide rail shaft 30 within the slide area L1.

The slide member 22 is biased, by the slide pressing spring 23 held by the slide member 22, in a direction in which the slide member 22 presses the abutting contact portion 22*c* against the retaining portion 20*a* of the upstream side holding portion 20. The slide member 22 also has a contact portion 22*b* that partly protrudes from the upstream side holding portion 20 and in which the protruding part is shaped like a circular arc at a leading end of thereof. Pushing in the contact portion 22*b* in the direction of arrow a moves the slide member 22 within the slide area L1. When the slide member 22 moves within the slide area L1, the upper movable blade rotating shaft 19*a* is tilted around the groove portion 21*b* in the downstream side holding portion 21 so as to change the inclination of the upper movable blade rotating shaft 19*a* to the direction orthogonal to the cutting direction X1. This changes the crossing angle θ of the upper movable blade 13*a*. When the cutter unit 12 reciprocates, the upstream side holding portion 20 and the downstream side holding portion 21 are guided with respect to the guide rail 10 depicted in FIG. 3.

When the abutting contact portion 22*c* of the slide member 22 maximally approaches the sliding preventing portion 21*a* of the downstream side holding portion 21 (as depicted in FIG. 5), the crossing angle θ is maximized. In contrast, when the abutting contact portion 22*c* of the slide member 22 maximally approaches the retaining portion 20*a* of the upstream side holding portion 20, the crossing angle θ is minimized. Thus, moving the slide member 22 enables a change in the crossing angle, which is the angle of the upper movable blade 13*a* to the cutting direction X1. In other words, while the rolled paper 1 is being cut, moving the slide member 22 enables the crossing angle θ to be changed even while the rolled paper 1 is being cut.

The crossing angle θ is an element related to a cutting property, and an increase in crossing angle θ allows the blades to appropriately bite into a sheet at the start of cutting (cutting performance). However, an increase in crossing angle θ leads to degraded cutting quality, such as a large amount of paper dust from a cutting surface of the rolled paper 1 being cut, or deteriorated durability of the blades. Thus, the quality of cutting surface of the paper (cutting quality) is enhanced by reducing the crossing angle at a predetermined timing after the start of the cutting.

The pressing force changing device 62 includes a spring holder 24, a pressing spring 25, an external holder 27, and a pressing device 28. The pressing force changing device 62 enables a change in a pressing force F exerted on the lower movable blade 13*b* by the upper movable blade 13*a*. The spring holder 24 is attached around the upper movable blade rotating shaft 19*a* so as to contact an inner ring portion of the bearing 18*a* of the upper movable blade 13*a*. The pressing spring 25 is held by the external holder at one end of the pressing spring 25 and by the spring holder 24 at the other end of the pressing spring 25. The pressing spring 25 presses the upper movable blade 13*a* against the lower movable blade 13*b* via the spring holder 24 and the bearing 18*a* of the upper movable blade 13*a*.

The external holder 27 is coupled to the pressing member 28 on a side thereof opposite to a side thereof that holds the pressing spring 25. The downstream side holding portion 21 is sandwiched between a thrust suppressing portion 27*a* of the external holder 27 and a thrust suppressing portion 28*a* of the pressing member 28. The external holder 27 is slidable with respect to the downstream side holding portion 21. The external holder 27 moves via the pressing member 28 to change an operating length of the pressing spring 25, thus changing the pressing force F exerted on the lower movable blade 13*b* by the upper movable blade 13*a*.

When the thrust suppressing portion 28*a* of the pressing member 28 maximally approaches the downstream side holding portion 21 (as depicted in FIG. 5), the pressing force F exerted on the lower movable blade 13*b* by the upper movable blade 13*a* is maximized. In contrast, when the thrust suppressing portion 27*a* of the external holder 27 maximally approaches the downstream side holding portion 21, the pressing force F exerted on the lower movable blade 13*b* by the upper movable blade 13*a* is minimized. Thus, moving the external holder 27 via the pressing member 28 enables a change in the pressing force F exerted on the lower movable blade 13*b* by the upper movable blade 13*a*. In other words, moving the external holder 27 via the pressing member 28 during the cutting of the rolled paper 1 enables a change in the pressing force F exerted on the lower movable blade 13*b* by the upper movable blade 13*a* even during the cutting of the rolled paper 1.

The pressing force F is an element related to the cutting property. An increase in pressing force F allows suppression of inappropriate cutting resulting from separation of the blades caused by cutting resistance from the sheet; the inappropriate cutting is likely to occur near the end of the rolled paper 1 at the start of the cutting. However, increasing the pressing force F causes the blades to be worn off, degrading the durability of the upper movable blade 13*a* and the lower movable blade 13*b*. Thus, at a predetermined timing after the start of the cutting, the pressing force is reduced to suppress degraded durability of the blades.

As depicted in FIG. 6, the rotary-blade rotating device 63 is provided in the cutter unit 12 and includes a rotation input gear 40*a*, a driven gear 40*b*, and a rotary blade rotating gear 40*c*. In the rotary-blade rotating device 63, the rotation input gear 40*a* meshes with a rack member 41 provided on the guide rail 10 to move relative to the guide rail 10, thus forcibly rotating the lower movable blade 13*b*. The rotation input gear 40*a* meshes with the rack member 41 provided on the guide rail 10 and is thus forcibly rotated in conjunction with movement of the cutter unit 12.

The rotation input gear 40*a* meshes with the rack member 41 provided on the guide rail 10 so as to be forcibly rotated in conjunction with movement of the cutter unit 12. The driven gear 40*b* transmits rotation of the rotation input gear 40*a* to the rotary blade rotating gear 40*c*. The rotary blade rotating gear 40*c* is integrally attached to the lower movable blade 13*b* such that the lower movable blade rotating shaft 19*b* corresponds to a central axis, so that the rotary blade rotating gear 40*c* can rotate integrally with the lower movable blade 13*b*. Forcibly rotating the rotary blade rotating gear 40*c* also rotates the lower movable blade 13*b*.

In an area where the rack member 41 is not provided, the rotary blade rotating gear 40*c* does not mesh with the rack member 41 and thus does not rotate. That is, within a movement area of the cutter unit 12, different areas are provided: the area where the rotation input gear 40*a* meshes with the rack member 41 and the area where the rotation input gear 40*a* does not mesh with the rack member 41. Consequently, the rotary-blade rotating device 63 enables switching between an area where the lower movable blade 13*b* is forcibly rotated and an area where the lower movable blade 13*b* is not rotated.

A moving speed of the cutter unit 12 is represented as a cutting speed V1. A peripheral speed of the lower movable blade 13*b* is represented as a peripheral speed V2. As the cutter unit 12 moves, the rotation input gear 40*a*, the driven gear 40*b*, and the rotary blade rotating gear 40*c* are forcibly rotated at a peripheral speed equal to the cutting speed V1 in the direction of an arrow in FIG. 6. Rotation of the rotary blade rotating gear 40*c* rotates the lower movable blade 13*b*, which rotates integrally with the rotary blade rotating gear 40*c*.

The pitch circle diameter of the rotary blade rotating gear 40*c*<the diameter of the lower movable blade 13*b*, and thus, the peripheral speed V2 of the lower movable blade 13*b* is higher than the cutting speed V1. In the present embodiment, the lower movable blade 13*b* has a diameter of 24 mm, and the rotary blade rotating gear 40*c* has a pitch circle diameter of 12 mm. Thus, the peripheral speed V2 of the lower movable blade 13*b* is approximately 2×V1, that is, approximately twice as high as the cutting speed V1, that is, the moving speed of the cutter unit 12. The speed of a cutting edge relative to the rolled paper 1 is approximately 2×V1, which is equal to the peripheral speed V2 of the lower movable blade 13*b*.

On the other hand, in the area where the rack member 41 is not provided, the lower movable blade 13*b* is not rotated by the rack member 41. However, when the rolled paper 1 is cut, the upper movable blade 13*a* and the lower movable blade 13*b* are moved at the cutting speed V1 equal to the moving speed of the cutter unit 12, while cutting the rolled paper 1. Thus, the upper movable blade 13*a* and the lower movable blade 13*b* rotate as a result of a frictional force between the rolled paper 1 and the blades. Consequently, when the rolled paper 1 is cut in the area where the rack member 41 is not provided, the upper movable blade 13*a* and the lower movable blade 13*b* rotate at the peripheral speed V2 approximately equal to the cutting speed V1 corresponding to the moving speed of the cutter unit 12. The speed of the cutting edge relative to the rolled paper 1 is approximately equal to the cutting speed V1, which is in turn equal to the peripheral speed V2 of the lower movable blade 13*b*.

On the other hand, when the rolled paper 1 is not being cut in the area where the rack member 41 is not provided, no force that rotates the lower movable blade 13*b* is obtained, and thus, the peripheral speed V2 of the lower movable blade 13*b* is zero. Consequently, the upper movable blade 13*a* and the lower movable blade 13*b* do not rotate. The speed of the cutting edge relative to the rolled paper 1 is zero, which is equal to the peripheral speed V2 of the lower movable blade 13*b*.

The case where the rolled paper 1 is not being cut occurs during a moving operation in the cutting direction X1 after the cutting of the rolled paper 1 ends and during a moving operation in the direction X2 when the cutter unit 12 returns to the standby position P1. While the rolled paper 1 is not being cut, the upper movable blade 13*a* is rotated in conjunction with rotation of the lower movable blade 13*b* as a result of friction between the upper movable blade 13*a* and the lower movable blade 13*b*. The upper movable blade 13*a* rotates at a speed lower than the peripheral speed V2 of the lower movable blade 13*b*. As described above, when a cutting path for the rolled paper 1 includes different parts: the part where the rack member 41 is provided and the part where the rack member 41 is not provided, the peripheral speed V2 of the lower movable blade 13*b* can be switched during cutting of the rolled paper 1.

In cutting using a disc-like circular blade, the peripheral speed, which is equal to the speed of the cutting edge relative to the rolled paper 1, is an element related to the cutting property. An increase in peripheral speed allows the blades to appropriately bite into the sheet. On the other hand, increasing the peripheral speed leads to degraded cutting quality such as a large amount of paper dust from the cutting surface or degraded durability of the blades. When the peripheral speed V2 of the lower movable blade 13*b* is increased with respect to the moving speed, an effect is enhanced which causes the rolled paper 1 to be drawn into the cutting point 15 between the upper movable blade 13*a* and the lower movable blade 13*b*. This is effective for enabling the blades to more appropriately bite into the sheet.

Figure 7:
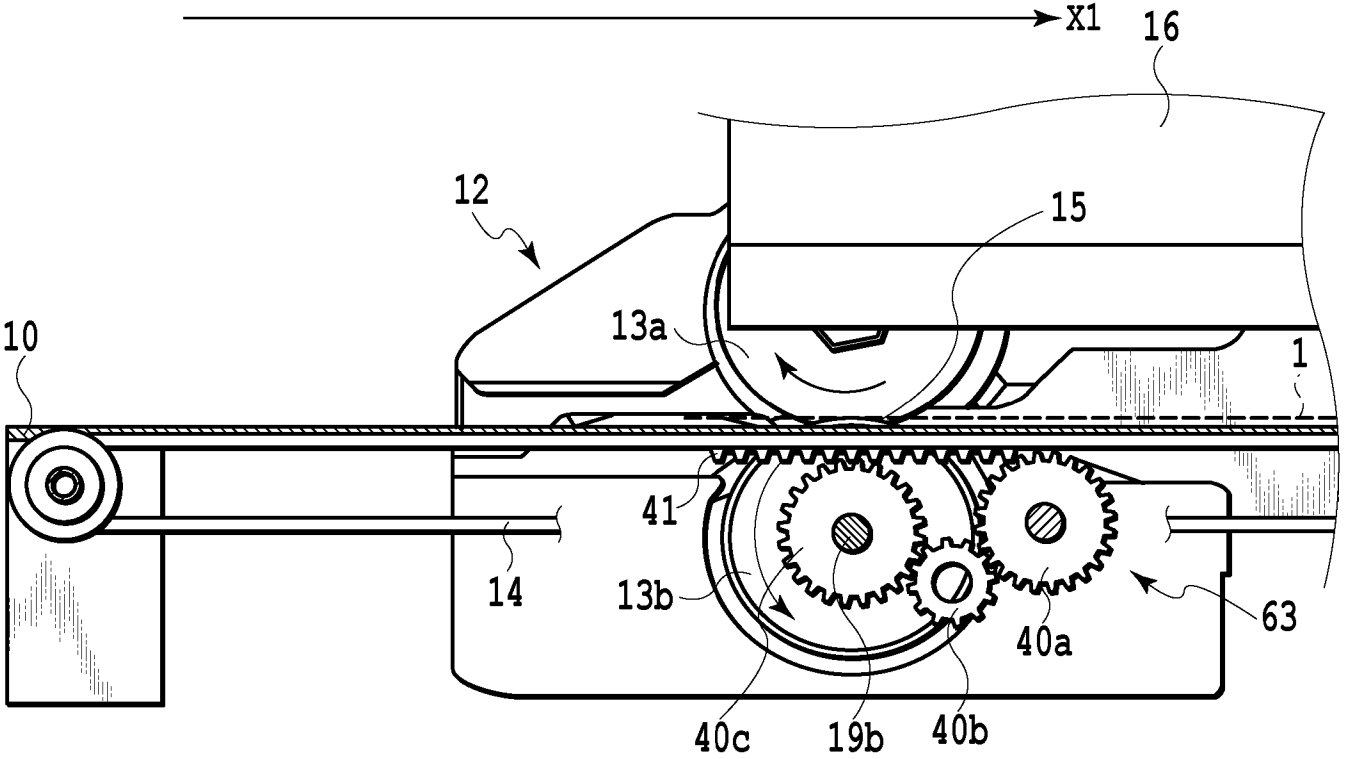
FIG. 7 is a schematic sectional view of the cutter unit according to the first embodiment as seen from behind during cutting.
Figure 8:
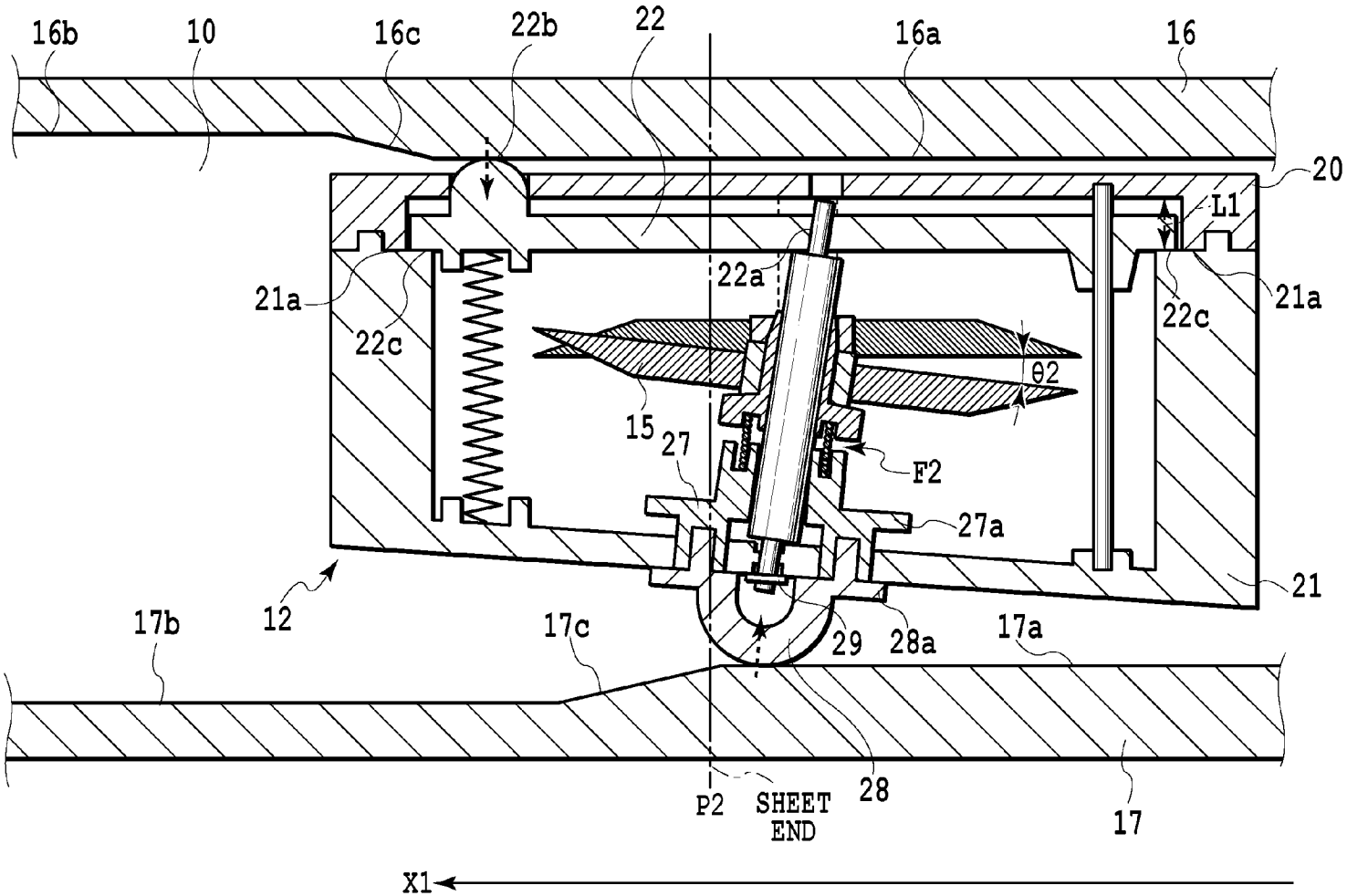
FIG. 8 is a schematic sectional view illustrating the cutter unit according to the first embodiment, when the cutter unit is in a cutting start point position.
Figure 9:
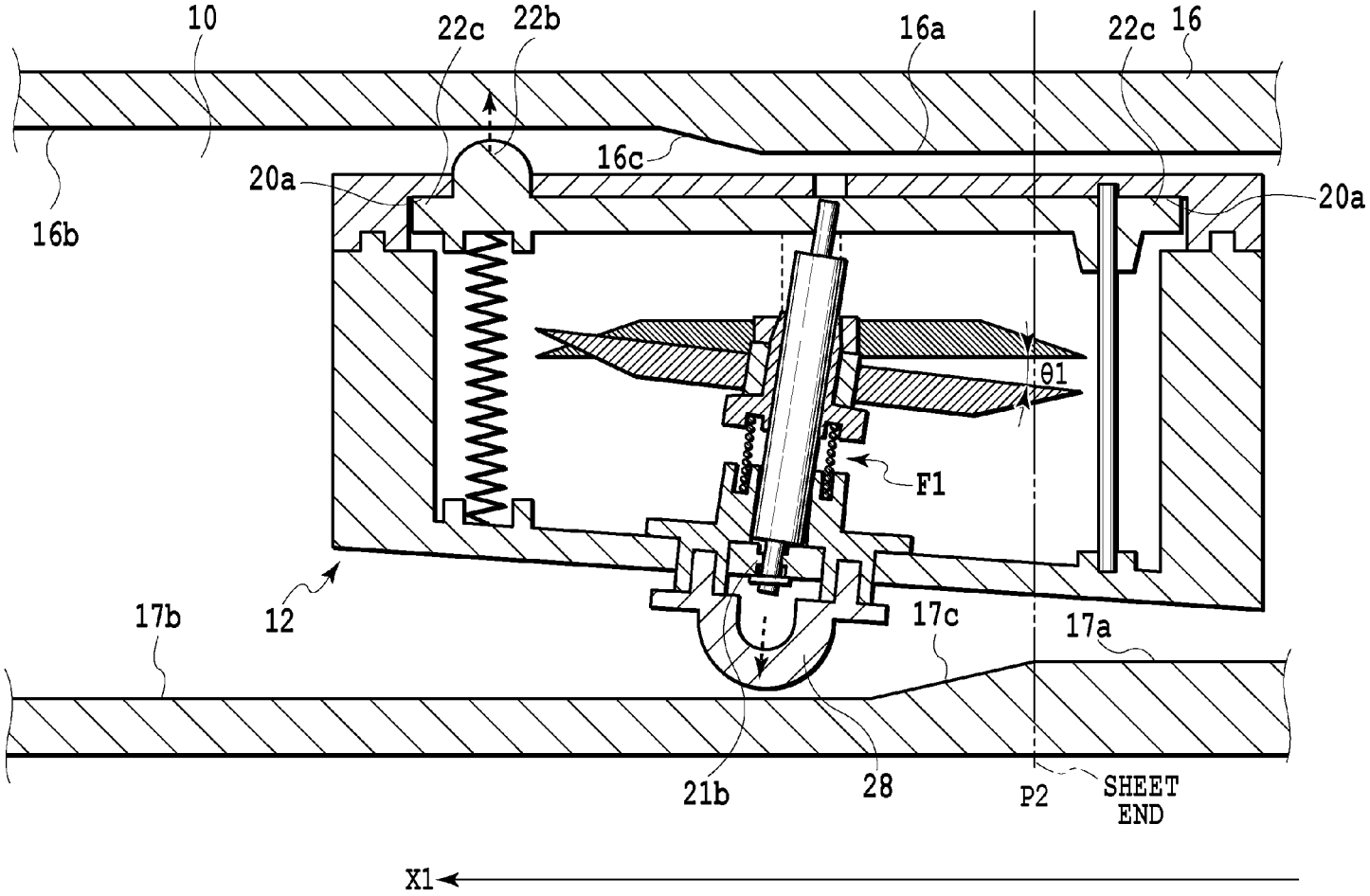
FIG. 9 is a diagram illustrating the cutter unit according to the first embodiment, when the cutter unit has moved further in a cutting direction.

FIG. 7 is a schematic sectional view of the cutter unit 12 according to the present invention during cutting as seen from behind, illustrating that the cutter unit 12 in the state illustrated in FIG. 6 has moved in the cutting direction X1 and depicting the rotary-blade rotating device rotating the lower movable blade 13*b* while the cutter unit is in the position of cutting. FIG. 8 is a schematic sectional view of the cutter unit according to the present invention in a cutting start point position as seen from above. FIG. 9 is a schematic sectional view depicting a state where the cutter unit in the state illustrated in FIG. 8 has further moved in the cutting direction X1 and where the cutter unit according to the present invention is in the position of cutting, as seen from above.

Now, with reference to FIG. 6, FIG. 7, FIG. 8, and FIG. 9, the operation of the cutter unit 12 changing cutting conditions during cutting by the cutting apparatus according to the present invention will be described in conjunction with effects of an upstream support member 16, effects of a downstream support member 17, and effects of the rack member 41.

The upstream support member changes the crossing angle θ of the upper movable blade 13*a* to the lower movable blade 13*b*. As depicted in FIG. 7, the upstream support member 16 is arranged above a surface of the rolled paper 1 on which the image is printed. The upstream support member 16 controls the position of the slide member 22 via the contact portion 22*b* of the cutter unit 12 to change the crossing angle θ of the upper movable blade 13*a* to the lower movable blade 13*b*. As depicted in FIG. 8, the upstream support member 16 includes a first flat surface (protruding portion) 16*a* that is a surface protruding in the conveying direction, which is orthogonal to the cutting direction X1, a second flat surface 16*b* that is a surface retracted at a predetermined distance from the first flat surface 16*a* in the conveying direction, and a slope portion 16*c* that joins the first flat surface 16*a* and the second flat surface 16*b* together.

The first flat surface 16*a* protrudes to the degree that the contact portion 22*b* is pushed to bring the abutting contact portion 22*c* of the slide member 22 nearly into contact with the sliding suppressing portion of the downstream side holding portion 21. As depicted in FIG. 8, when the contact portion 22*b* is in a position corresponding to the first flat surface 16*a* in the cutting direction, that is, when the cutter unit 12 is in a position where the contact portion 22*b* is pushed in by the first flat surface 16*a*, the crossing angle θ of the upper movable blade 13*a* to the cutting direction X1 is maximized (crossing angle θ=θ2). At a crossing angle θ=θ2 where the crossing angle θ is maximized, the blades appropriately bite into the sheet. This prevents a situation where, when the cutting point 15 between the upper movable blade 13*a* and the lower movable blade 13*b* passes through a cutting start point P2 for the rolled paper 1, the blades fail to bite into the sheet, which is then deformed.

The second flat surface 16*b* is provided on a traveling direction side (opposite to the standby position P1) in the cutting direction during cutting with respect to the first flat surface 16*a*. The second flat surface 16*b* is retracted to the degree that, with the abutting contact portion 22*c* of the slide member 22 in contact with the retaining portion 20*a* of the upstream side holding portion 20, the contact portion 22*b* of the slide member 22 does not contact the second flat surface 16*b*. That is, as depicted in FIG. 9, when the contact portion 22*b* is in the position corresponding to the second flat surface 16*b* in the cutting direction, the cutter unit 12 is not pushed in because the contact portion 22*b* of the slide member 22 does not contact the second flat surface 16*b*.

At this time, the spring bias force of the slide pressing spring 23 brings the abutting contact portion 22*c* of the slide member 22 into contact with the retaining portion 20*a* of the upstream side holding portion 20. Thus, the crossing angle θ of the upper movable blade 13*a* to the lower movable blade 13*b* is minimized (crossing angle θ=θ1). At a crossing angle θ=θ1 where the crossing angle θ is minimized, cutting can be achieved such that the cutting surface of the rolled paper 1 being cut exhibits high quality, suppressing possible paper dust during the cutting.

In connection with movement of the cutter unit 12 in the cutting direction X1, the first flat surface 16*a* is arranged such that at least when the cutting point 15 of the cutter unit 12 is positioned at the cutting start point P2 where the cutting of the rolled paper 1 is started, the contact portion 22*b* comes into contact with the first flat surface 16*a*. Specifically, the first flat surface 16*a* is formed to extend from a position closer to the standby position P1 than the cutting start point P2 in the cutting direction to a position on the traveling direction side in the cutting direction with respect to the end of the rolled paper 1. Thus, the contact portion 22*b* remains in contact with the first flat surface 16*a* until the cutting point 15 reaches the cutting start point P2.

The slope portion 16*c* is arranged so as to extend from a position to which, during the cutting, the cutting point 15 of the cutter unit 12 moves a predetermined distance after passing through the cutting start point P2. In this regard, the predetermined distance is determined with a variation in the sheet end position of the rolled paper 1 taken into account and, for example, corresponds to one rotation of the upper movable blade 13*a* following the start of the cutting of the rolled paper 1. In the present embodiment, the predetermined distance is 5 to 80 mm from the cutting start point P2.

The slope portion 16*c* smoothly joins the first flat surface 16*a* and the second flat surface 16*b* together to suppress a rapid change in the position of the slide member 22, thus restraining damage to the upper movable blade 13*a* and the lower movable blade 13*b* caused by a rapid change in the crossing angle θ of the upper movable blade 13*a*. The slope portion 16*c* may be a flat surface or a curved surface as long as the slope portion 16*c* allows the first flat surface 16*a* and the second flat surface 16*b* to be smoothly joined together. In the above description, the second flat surface 16*b* is retracted to the degree that, with the abutting contact portion 22*c* of the slide member 22 in contact with the retaining portion 20*a* of the upstream side holding portion 20, the contact portion 22*b* of the slide member 22 does not contact the second flat surface 16*b*. However, the present embodiment is not limited to this configuration. For example, the second flat surface 16*b* may be positioned to the degree that the abutting contact portion 22*c* of the slide member 22 contacts the second flat surface 16*b*, and, more specifically, to the degree that the abutting contact portion 22*c* of the slide member 22 contacts the retaining portion 20*a* of the upstream side holding portion 20.

As described above, in the present embodiment, the crossing angle changing device 61 and the upstream support member 16 provided in the cutting apparatus 5 enable the crossing angle θ of the upper movable blade 13*a* to be changed while the rolled paper 1 is being cut. When the cutting of the rolled paper 1 is started (cutting start point P2), the crossing angle θ of the upper movable blade 13*a* is set to a large value because the blades have difficulty biting into the sheet. This allows the blades to appropriately bite into the sheet to prevent a situation where the sheet starts to be deformed at the position of abutting contact with the blades and is thus pushed in the cutting direction X1, resulting in inappropriate cutting. On the other hand, in the area corresponding to a time following the start of the cutting, the inappropriate cutting resulting from the pushing of the sheet in the cutting direction X1 is unlikely to occur. Thus, the crossing angle θ of the upper movable blade 13*a* is set to a small value to suppress degraded cutting quality such as a large amount of paper dust from the cutting surface or degraded durability of the blades.

As described above, the cutting apparatus of the present embodiment includes the crossing angle changing device that changes the crossing angle θ, which is the angle of the upper movable blade 13*a* to the lower movable blade 13*b*, while the cut medium is being cut. In the crossing angle changing device, the upstream support member 16 includes the first flat surface 16*a* and the second flat surface 16*b*. Before the cutter unit 12 performs cutting and when the cutter unit 12 is in the cutting start point P2, the slide member 22 contacts the first flat surface 16*a* and is pushed downstream in the conveying direction to tilt the upper movable blade rotating shaft 19*a*, increasing the crossing angle θ. Thus, at the start of the cutting, the blades appropriately bite into the sheet to allow the cutting performance to be enhanced. During the cutting, the slide member 22 reaches the second flat surface 16*b* through the slope portion 16*c* and is slid toward the upstream side holding portion 20. Consequently, the crossing angle θ decreases to allow the quality of the cutting surface to be restrained from being degraded.

In the present embodiment, the first flat surface 16*a* extends from the position corresponding to a time preceding the start of the cutting to the position where the cutting point 15 of the cutter unit 12 reaches the cutting start point P2. However, the present embodiment is not limited to this configuration. For example, the first flat surface 16*a* may be formed at a position corresponding to a time immediately before the end of the cutting to increase the crossing angle θ to enhance the cutting performance. This configuration prevents a situation where the sheet above the sheet discharge guide 11 falls obliquely starting with a cutting start side of the sheet, to raise an uncut part of the sheet, resulting in inappropriate cutting. Alternatively, a flat surface with a protruding distance equivalent to the protruding distance of the first flat surface 16*a* may be provided in two areas including an area corresponding to an initial period of the cutting and an area corresponding to a time immediately before the end of the cutting. Thus, the protruding distance of the upstream support member 16 and the location of the upstream support member 16 are not limited to those in the present embodiment but may be freely set in order both to enhance the cutting performance and to ensure the cutting quality.

The downstream support member changes the pressing force exerted on the lower movable blade 13*b* by the upper movable blade 13*a*. The downstream support member 17 is arranged above the surface of the rolled paper 1 on which the image is printed. The downstream support member 17 controls the position of the external holder 27 via the pressing member 28 of the cutter unit 12 to change the pressing force exerted on the lower movable blade 13*b* by the upper movable blade 13*a* as depicted in FIG. 8. The downstream support member 17 has undulating surfaces, and has a first flat surface 17*a* that is a surface protruding in a direction opposite to the conveying direction orthogonal to the cutting direction X1, a second flat surface 17*b* retracted at a predetermined distance from the first flat surface 17*a*, and a slope portion 17*c* that joins the first flat surface 17*a* and the second flat surface 17*b* together.

The first flat surface 17*a*, which is a part of the undulating portion, protrudes to the degree that the thrust suppressing portion 28*a* of the pressing member 28 is pushed in and brought nearly into contact with the downstream side holding portion 21. That is, when the cutter unit 12 is in a position where the pressing member 28 is pushed in by the first flat surface 16*a*, the pressing force F exerted on the lower movable blade 13*b* by the upper movable blade 13*a* is maximized (pressing force F=F2). At the start of the cutting, inappropriate cutting is likely to result from separation of the blades caused by cutting resistance from the sheet. Thus, near the end of the rolled paper 1, the pressing force F exerted on the lower movable blade 13*b* by the upper movable blade 13*a* is maximized in order to suppress inappropriate cutting. That is, at the start of the cutting, the upper movable blade 13*a* and the lower movable blade 13*b* are brought into contact with each other by a strong force near the end of the rolled paper 1.

The second flat surface 17*b* is retracted to the degree that, with the thrust suppressing portion 27*a* of the external holder 27 in contact with the downstream side holding portion 21, the pressing member 28 does not contact the second flat surface 17*b*. As depicted in FIG. 9, when the pressing member 28 is in a position corresponding to the second flat surface 17*b* in the cutting direction, the pressing member 28 does not contact the second flat surface 17*b* and is thus not pushed in. When the cutter unit 12 is in this position, the pressing force F exerted on the lower movable blade 13*b* is minimized (pressing force F=F1). The minimized pressing force F exerted on the lower movable blade 13*b* restrains the durability of the upper movable blade 13*a* and the lower movable blade 13*b* from being degraded as a result of the wear of the blades.

In connection with movement of the cutter unit 12 in the cutting direction X1, the first flat surface 17*a* is arranged such that at least when the cutting point 15 of the cutter unit 12 reaches the cutting start point P2 where the cutting of the rolled paper 1 is started, the pressing member 28 comes into contact with the first flat surface 17*a* and is pushed a predetermined distance by the first flat surface 17*a*. The slope portion 17*c* is arranged so as to extend from a position to which, during the cutting, the cutter unit 12 moves predetermined distance after the cutting point 15 of the cutter unit 12 passes through the cutting start point P2. Specifically, the first flat surface 17*a* is provided so as to extend from a position closer to the standby position P1 than the cutting start point P2 in the cutting direction, to a position slightly closer to the standby position than the end of the rolled paper 1 in the cutting direction. Thus, the pressing member 28 remains in contact with the first flat surface 17*a* until the cutting point 15 reaches the cutting start point P2.

The slope portion 17*c* smoothly joins the first flat surface 17*a* and the second flat surface 17*b* together to suppress a rapid change in the position of the external holder 27 via the pressing member 28, thus restraining damage to the upper movable blade 13*a* and the lower movable blade 13*b* caused by a rapid change in the pressing force F. The slope portion 17*c* may be a flat surface or a curved surface as long as the slope portion 17*c* allows the first flat surface 17*a* and the second flat surface 17*b* to be smoothly joined together. In the above description, the second flat surface 17*b* is retracted to the degree that, with the thrust suppressing portion 27*a* of the external holder 27 in contact with the downstream side holding portion 21, the pressing member 28 does not contact the second flat surface 17*b*. However, the present embodiment is not limited to this configuration. For example, the second flat surface 17*b* may be positioned to the degree that the thrust suppressing portion 27*a* of the external holder 27 contacts the downstream side holding portion 21.

As described above, the pressing force changing device 62 and the downstream support member 17 provided in the cutting apparatus 5 enable the pressing force F exerted on the lower movable blade 13*b* to be changed while the rolled paper 1 is being cut. That is, near the cutting start point of the rolled paper 1 where the blades have difficulty biting into the sheet, the pressing force exerted on the lower movable blade 13*b* is set to a large value. This allows the blades to more reliably contact each other, suppressing possible inappropriate cutting resulting from separation of the blades caused by cutting resistance from the sheet. On the other hand, in an area corresponding to a time following the start of the cutting, the inappropriate cutting resulting from separation of the blades is unlikely to occur. Thus, the pressing force F exerted on the lower movable blade 13*b* is set to a small value to suppress degraded durability resulting from the wear of the blades.

In connection with movement of the cutter unit 12 in the cutting direction X1, the first flat surface 17*a* is arranged such that the pressing member 28 comes into contact with the first flat surface 17*a* at least at the cutting start point P2 where the cutter unit 12 starts cutting the rolled paper 1. The slope portion 17*c* is arranged so as to extend from a position to which, during the cutting, the cutter unit 12 moves a predetermined distance after passing through the cutting start point P2. In this regard, the predetermined distance is determined with a variation in the sheet end position of the rolled paper 1 taken into account and, for example, corresponds to one rotation of the upper movable blade 13*a* following the start of the cutting of the rolled paper 1. In the present embodiment, the predetermined distance is 5 to 80 mm from the cutting start point P2.

In the present embodiment, the first flat surface 17*a* extends from a position corresponding to a time preceding the start of the cutting, to a position where the cutting point 15 reaches the cutting start point P2. The first flat surface 17*a* may be formed at a position corresponding to a time immediately before the end of the cutting to increase the pressing force F to enhance the cutting performance. This configuration prevents a situation where the sheet above the sheet discharge guide 11 falls obliquely starting with the cutting start side of the sheet, to raise the uncut part of the sheet, resulting in inappropriate cutting.

The rack member changes the peripheral speed of the lower movable blade 13*b*. The rack member 41 is provided on the guide rail 10, and meshes with and forcibly rotates the lower movable blade 13*b* to change the peripheral speed of the lower movable blade 13*b* as depicted in FIG. 6. The rack member 41 is arranged such that at least at the cutting start point P2 where the cutter unit 12 starts cutting the rolled paper 1, the rotation input gear 40*a* meshes with the rack member 41 to forcibly rotate the lower movable blade 13*b* as depicted in FIG. 6.

That is, at the cutting start point P2 where cutting is started, the rotation input gear 40*a* (pinion gear) meshes with the rack member 41 to make the peripheral speed V2 of the lower movable blade 13*b* higher than the cutting speed V1 corresponding to the moving speed of the cutter unit 12. The peripheral speed V2 of the lower movable blade 13*b* is increased to allow the blades to appropriately bite into the sheet at the start of the cutting. This suppresses a situation where the sheet starts to be deformed at the position of abutting contact with the blades and is thus pushed in the cutting direction X1, resulting in inappropriate cutting.

In the present embodiment, the rack member 41 is provided so as to extend from the standby position P1 to a predetermined position at which the cutter unit 12 arrives after passing through the cutting start point P2. That is, the rack member 41 is arranged so as to extend from the cutting start point P2 to a position where the rolled paper 1 has been cut by a predetermined length. In the present embodiment, the predetermined length is set with a variation in the sheet end position of the rolled paper 1 taken into account. In the present embodiment, for example, the predetermined length corresponds to an amount of time from the start of cutting of the rolled paper 1 by the upper movable blade 13*a* until the upper movable blade 13*a* has made one rotation, that is, 5 to 80 mm. The cutting over this distance is defined as an initial cutting operation.

As the cutter unit 12 further moves in the cutting direction X1, the cutter unit 12 encounters an area where the rack member 41 is not provided, as depicted in FIG. 7. That is, the rotation input gear 40*a* does not mesh with the rack member 41. Thus, when the rolled paper 1 is cut, the lower movable blade 13*b* is rotated by the frictional force between the lower movable blade 13*b* and the rolled paper 1. At this time, the peripheral speed V2 is approximately equal to the cutting speed V1 corresponding to the moving speed of the cutter unit 12. When the rolled paper 1 is not cut (during a moving operation following the end of the cutting or the like), the peripheral speed V2 of the lower movable blade 13*b* is zero. Consequently, the upper movable blade 13*a* and the lower movable blade 13*b* do not rotate relative to each other.

In the present embodiment, the rack member 41 rotates the lower movable blade 13*b*. However, the present embodiment is not limited to this configuration. The upper movable blade 13*a* may be rotated or both the upper movable blade 13*a* and the lower movable blade 13*b* may be rotated.

As described above, when the rotary-blade rotating device installed in the cutting apparatus 5 is provided on a part of the guide rail 10, it is possible to set the area where one of the movable blades is forcibly rotated while the rolled paper 1 is being cut and the area where neither of the movable blades are rotated while the rolled paper 1 is being cut. This enables the peripheral speed V2 of the lower movable blade 13*b* to be changed. In the present embodiment, near the cutting start point of the rolled paper 1 where the blades have difficulty biting into the sheet, the rack member 41 is provided to set a high peripheral speed V2 for the lower movable blade 13*b* to allow the blades to approximately bite into the sheet. This suppresses a situation where the sheet starts to be deformed at the position of abutting contact with the blades and is thus pushed in the cutting direction X1, resulting in inappropriate cutting.

On the other hand, in an area corresponding to a time following the start of the cutting, the inappropriate cutting resulting from pushing of the sheet in the cutting direction X1 is unlikely to occur. Thus, the rack member 41 is omitted to make the peripheral speed V2 approximately equal to the cutting speed to suppress degraded cutting quality such as a large amount of paper dust from the cutting surface or degraded durability of the blades. Moreover, in an area where the sheet is not cut, the peripheral speed V2 of the lower movable blade 13*b* is zero, and the blades are protected from wear resulting from the relative rotation of the blades. This restrains the durability of the upper movable blade 13*a* and the lower movable blade 13*b* from being degraded.

Figure 10:
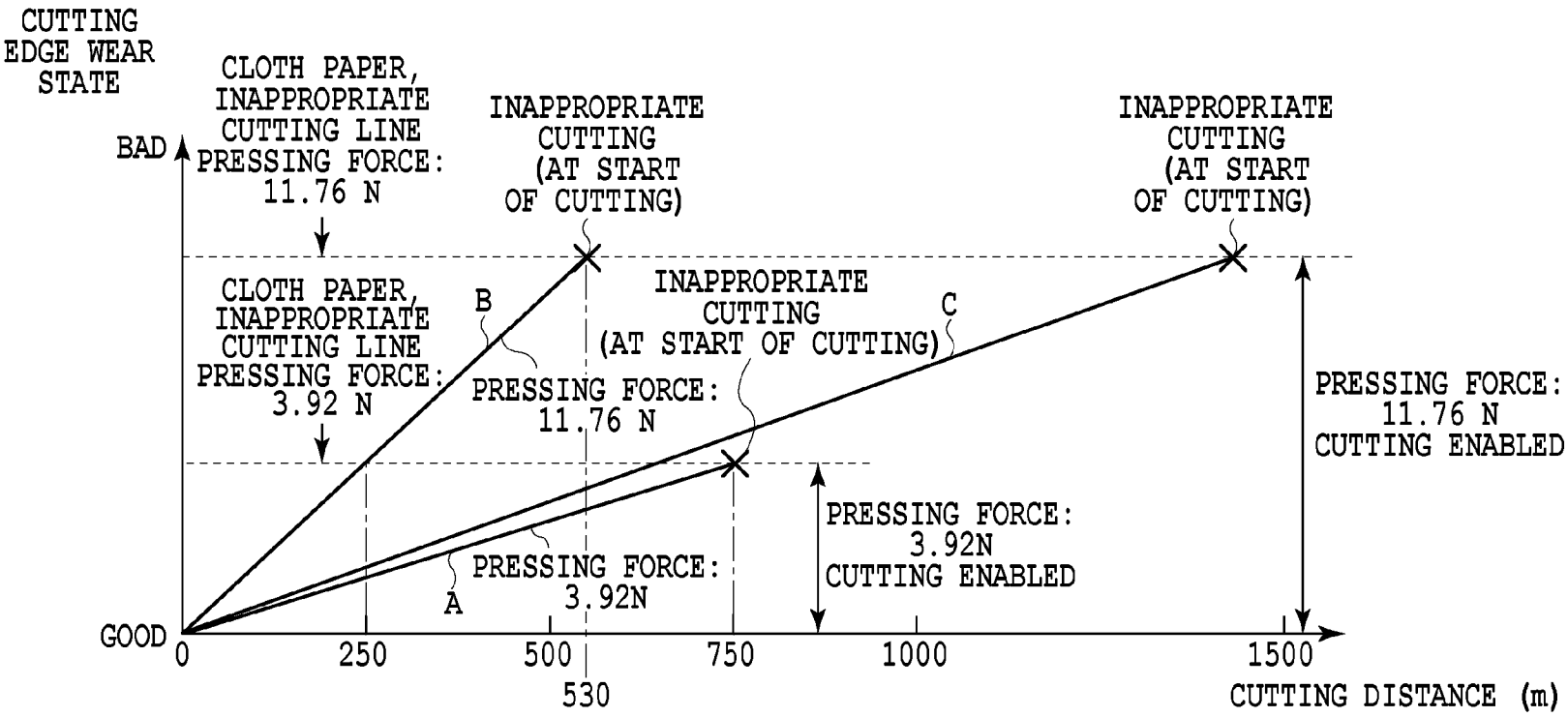
FIG. 10 is a graph illustrating a relation between a wear state of cutting edges and a cutting distance.
Figure 11A:
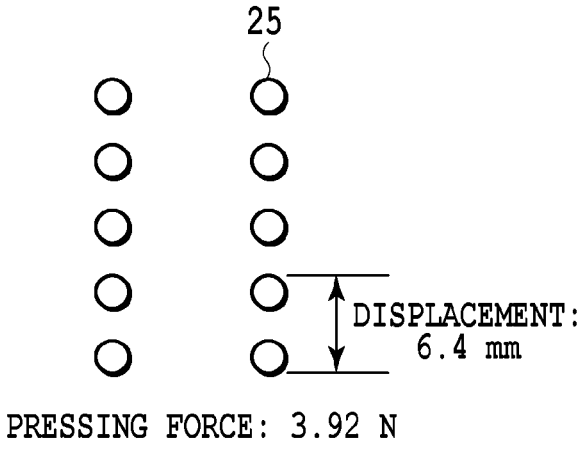
FIG. 11A is a schematic diagram illustrating the displacement of a pressing spring.
Figure 11B:
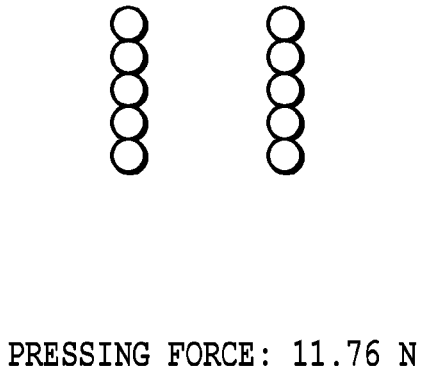
FIG. 11B is a schematic diagram illustrating the displacement of the pressing spring.

FIG. 10 is a graph illustrating the results of experiments for verifying the relation between the wear state of the cutting edges and cutting distance for each pressing force F exerted on the lower movable blade 13*b* by the upper movable blade 13*a*. FIG. 11A and FIG. 11B are a schematic diagram illustrating the displacement of the pressing spring. With reference to FIG. 10, FIG. 11A and FIG. 11B, the pressing force changing device 62 in the present embodiment will be described in detail. A cut material verified in FIG. 10 was cloth paper with high cutting resistance. The verification was performed by repeatedly performing cutting operations with a given amount of rolled paper with a given width conveyed.

As depicted in FIG. 10, when (A) the pressing force F exerted on the lower movable blade 13*b* by the upper movable blade 13*a* was 3.92 N both for the start of the cutting and for the cutting in execution, the blades started to inappropriately bite, leading to inappropriate cutting, when a total cutting distance exceeded approximately 750 m.

When the inappropriate cutting occurred, increasing the pressing force F up to 11.76 N allowed the blades to appropriately bite again, enabling the cutting to start (this is not depicted in the drawings). A cause of the inappropriate cutting in this case is the wear of the cutting edges, but the major cause is expected to be a weak pressing force F.

In contrast, when (B) the pressing force F exerted on the lower movable blade 13*b* by the upper movable blade 13*a* is initially set to 11.76 N both for the start of the cutting and for the cutting in execution, the wear state of the cutting edges is equivalent to the wear state observed when the inappropriate cutting occurred in the experiment (A). However, the weak pressing force F prevents the inappropriate cutting at this point in time. Then, when the cutting was subsequently continued, the inappropriate cutting occurred at the start of the cutting when the total cutting distance exceeded approximately 530 m. The cause of this inappropriate cutting is expected to be the wear of the cutting edges resulting from the increased pressing force F.

The experiments (A) and (B) indicate that, even when the wear state of the cutting edges is degraded to a given level, the cutting can be continued by increasing the pressing force F exerted on the lower movable blade 13*b* by the upper movable blade 13*a*. Furthermore, the experiments indicate that an excessive pressing force F causes the cutting edges to be quickly worn off and is unsuitable for long-distance cutting. Thus, when (C) the cutting was performed with the pressing force F exerted on the lower movable blade 13*b* by the upper movable blade 13*a* set to 11.76 N only for the start of the cutting and to 3.92 N for the cutting in execution, the cutting operation was successfully performed over a cutting distance approximately twice as long as the cutting distance in the experiment (A).

In the present embodiment, the elastic force of the pressing spring 25 is utilized to allow the upper movable blade 13*a* to exert the pressing force F on the lower movable blade 13*b* as depicted in FIG. 11A and FIG. 11B. In the present embodiment, the displacement of the spring is 6.4 mm when the pressing force F is switched from 3.92 N to 11.76 N. In other words, with respect to the position of the second flat surface 17*b* of the downstream support member 17, the first flat surface 17*b* is arranged at a position where the first flat surface 16*a* pushes in the pressing member by 6.4 mm. The thus arranged first flat surface 17*a* is placed at the cutting start point P2 where the cutter unit 12 starts cutting the rolled paper 1, to press the pressing member 28. Then, after the cutter unit 12 passes through the cutting start point P2, the second flat surface 17*b* is placed at a position opposite to the pressing member 28. This allows for a change in the pressing force F exerted by the upper movable blade 13*a* on the lower movable blade 13*b* in the process of the cutting.

As described above, the cutting apparatus of the present embodiment has the pressing force changing device that switches the pressing force F exerted on the lower movable blade 13*b* by the upper movable blade 13*a* while the cut medium is being cut. In the pressing force changing device, the downstream support member 17 includes the first flat surface 17*a* and the second flat surface 17*b* retracted downstream with respect to the first flat surface 16*a* by the predetermined distance in the conveying direction. Thus, before the start of cutting with the cutter unit 12 and at the cutting start point P2, the pressing member 28 contacts the first flat surface 17*a* and is pushed downstream in the conveying direction to press the upper movable blade 13*a*, increasing the pressing force F. Thus, at the start of the cutting, the upper movable blade 13*a* is prevented from leaving the lower movable blade 13*b* to allow the lower movable blade 13*b* to bite into the cut medium, enabling the cutting performance to be enhanced. During the cutting, the pressing member 28 reaches the second flat surface 16*b* through the slope portion 16*c* to reduce the pressing force, allowing the wear of the cutting edges to be suppressed.

In the present embodiment, the pressing force F between the two blades is changed during the cutting operation to allow suppression of the wear of the cutting edges while enhancing the cutting performance at the start of the cutting as described above.

In the present embodiment, according to a change in the state of the contact between the pressing member 28 and the downstream support member 17, the thrust suppressing portion 27*a* of the external holder 27 slides to allow for a change in the pressing force exerted on the upper movable blade 13*a* by the lower movable blade 13*b*.

One blade of the pair of blades is changed to change the crossing angle between the two blades. At this time, with a shaft of the one blade (upper movable rotary blade 13*a*) unmoved, the slide member 22 supporting the shaft is moved in a direction crossing the cutting direction (in the present embodiment, the upper-movable-blade rotating shaft 19*a*). Then, the accuracy of a change in crossing angle can be improved regardless of the reaction force from the paper or the like.

In the present embodiment, the sliding distance of the slide member 22 pivotally supporting the upper-movable-blade rotating shaft 19*a* is adjusted using the groove portion 22*a* formed in the upstream side holding portion 20 and the groove portion 21*b* formed in the downstream side holding portion 21. Thus, the sliding distance can be accurately managed.

The cutting apparatus in the present embodiment uses the circular blades, and thus compared to a cutting apparatus using knife-like blade, advantageously provides appropriate cutting surfaces, enables a variety of print media to cut, and has a long life. Furthermore, compared to a cutting apparatus in which one of the blades is an elongate fixed blade, the cutting apparatus in the present embodiment advantageously saves cost and space.

Second Embodiment

A second embodiment of the present invention will be described with reference to the drawings. A basic configuration of the present embodiment is similar to the basic configuration of the first embodiment, and only a characteristic part of the configuration will be described below.

The second embodiment of the present invention will be described with reference to FIG. 12, FIG. 13, FIG. 14, FIG. 15A, and FIG. 15B. A variation of the pressure spring 25 serving as a pressing force changing device and a periphery of the pressure spring 25 are illustrated. However, the same components as those of the first embodiment are denoted by the same reference numerals and will not be described below.

Figure 12:
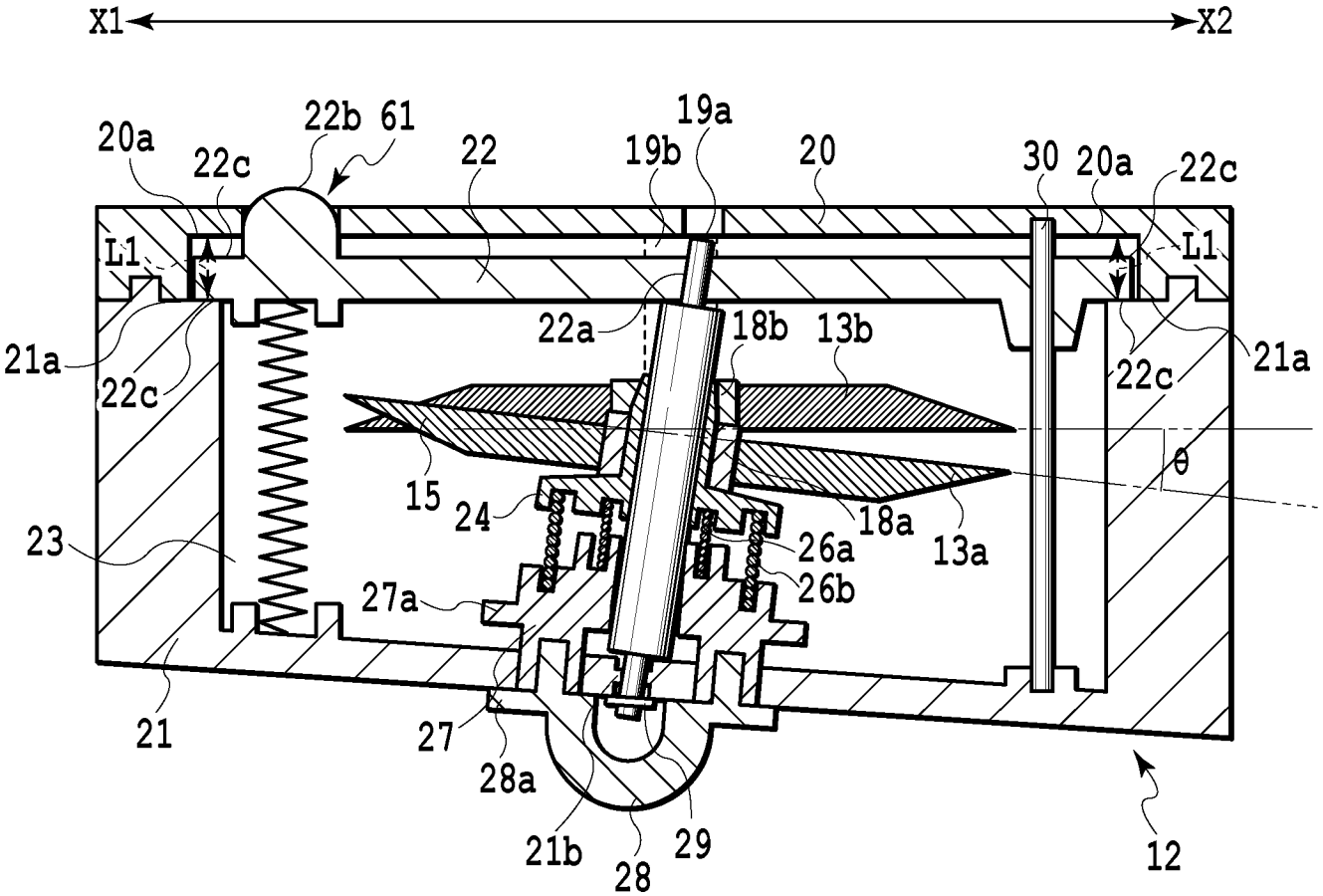
FIG. 12 is a schematic sectional view of the cutter unit of the present embodiment when viewed from above.

FIG. 12 is a schematic sectional view of the cutter unit 12 of the present embodiment as seen from above. The upper movable blade 13*a* in the cutter unit 12 of the present embodiment is pressed against the lower movable blade 13*b* by two springs, a low-pressing-force spring 26*a* and a high-pressing-force spring 26*b*. The low-pressing-force spring 26*a* and the high-pressing-force spring 26*b* are held by the spring holder 24 and the external holder 27. The outer diameter of the high-pressing-force spring 26*b* is larger than the outer diameter of the low-pressing-force spring 26*a*. The high-pressing-force spring 26*b* is arranged outside and coaxially with the low-pressing-force spring 26*a*. The outer diameter of the low-pressing-force spring 26*a* may be set larger than the outer diameter of the high-pressing-force spring 26*b*, with the outside arrangement and the inside arrangement reversed.

In the present embodiment, the two springs are used to allow the upper movable blade 13*a* to exert the pressing force F on the lower movable blade 13*b*. However, the present invention is not limited to this configuration. For example, three or more springs may be used to apply the pressing force. Specifically, besides the high-pressing-force spring and the low-pressing-force spring, an intermediate-pressing-force spring may be used.

Figure 13:
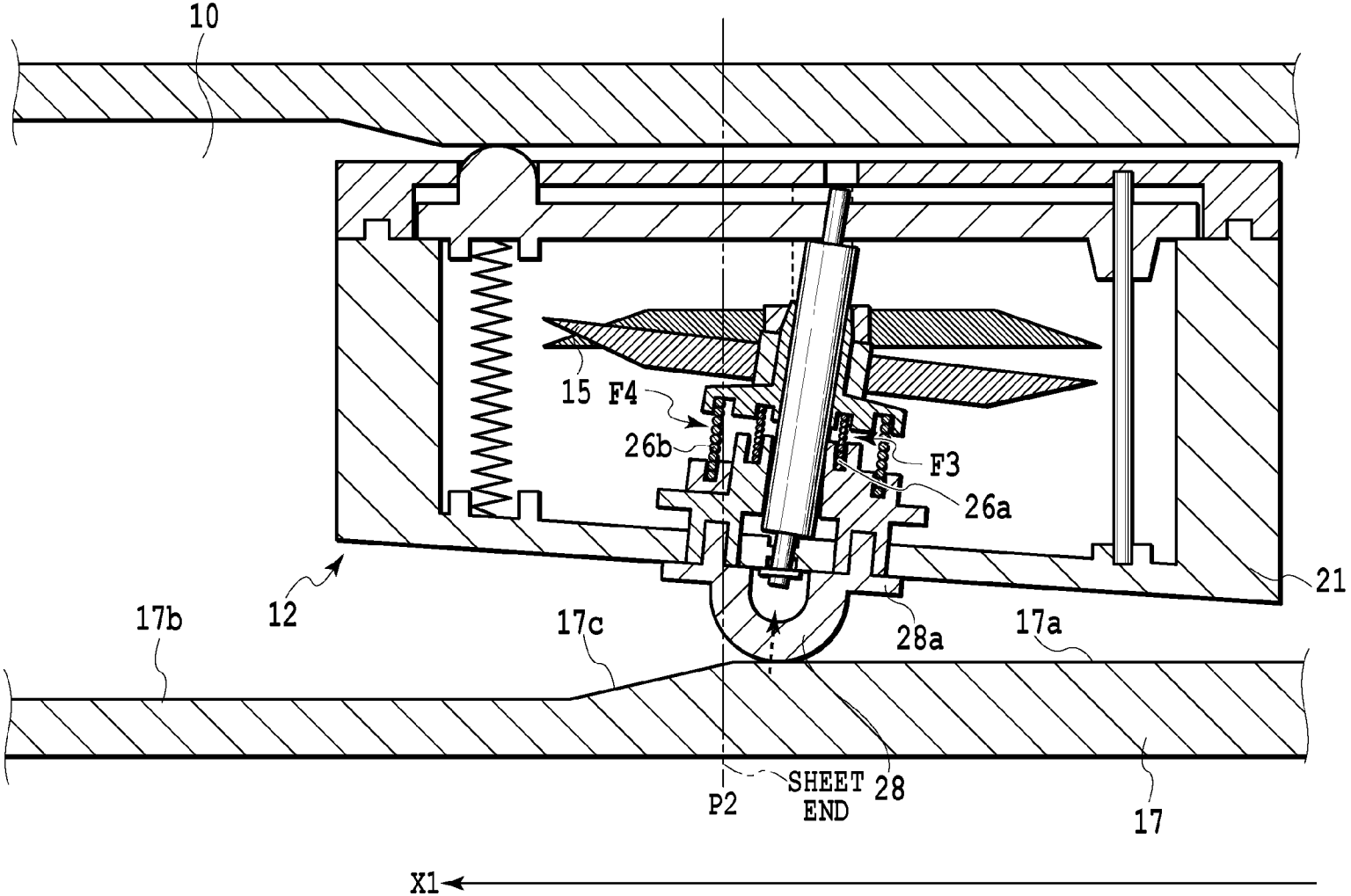
FIG. 13 is a top view illustrating a state where the cutter unit is in the cutting start point position.
Figure 14:
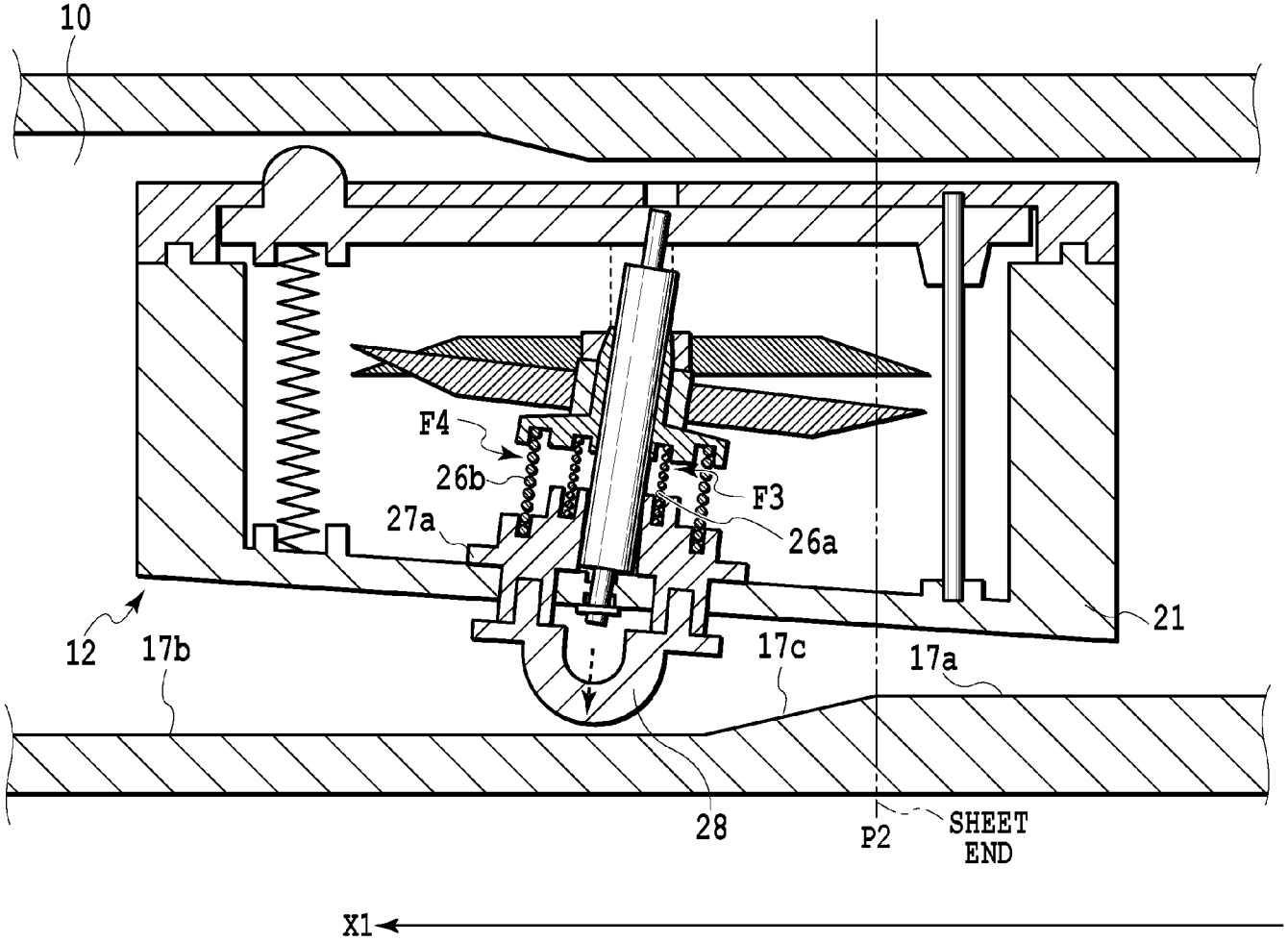
FIG. 14 is a top view illustrating a state where the cutter unit is performing cutting.

FIG. 13 is a top view illustrating that the cutter unit 12 is at the cutting start point position. FIG. 14 is a top view depicting a state where the cutter unit 12 is performing cutting.

At the cutting start position, the pressing member 28 is pushed by the first flat area 17*a* to keep the thrust suppressing portion 27*a* in abutting contact with the downstream side holding portion 21 as depicted in FIG. 13. At this time, the pressing force F3 of the low-pressing-force spring 26*a* is 3.92 N, and the pressing force F4 of the high-pressing-force spring 26*b* is 7.84 N. In other words, at the cutting start position, the upper movable blade 13*a* presses the lower movable blade 13*b* by a force equal to the total of the pressing force F3 of the low-pressing-force spring 26*a* and the pressing force F4 of the high-pressing-force spring 26*b*, that is, 11.76 N.

As depicted in FIG. 14, after the cutting start position is passed, when the pressing member 28 is at a position opposite to the second flat area 17*b*, the pressing member 28 is not pressed by the second flat area 17*b*. Thus, the thrust suppressing portion 27*a* is in abutting contact with the downstream side holding portion 21. At this time, the pressing force F3 of the low-pressing-force spring 26*a* is 3.92 N, and the pressing force F4 of the high-pressing-force spring 26*b* is 0 N.

In other words, when the pressing member 28 is at a position opposite to the second flat area 17*b*, the high-pressing-force spring 26*b* exerts no bias force. After the cutting start position is passed, the upper movable blade 13*a* presses the lower movable blade 13*b* by a force equal to the total of the pressing force F3 of the low-pressing-force spring 26*a* (3.92 N) and the pressing force F4 of the high-pressing-force spring 26*b* (0 N), that is, 3.92 N. After the cutting start position is passed, the pressing member 28 may or may not be in abutting contact with the second flat area 17*b* as long as the pressing force F4 is 0 N.

As described above, the two springs, the high-pressing-force spring and the low-pressing-force spring, are used for the pressing, enabling a reduction in displacement at the time of pressing. Therefore, the apparatus can be miniaturized.

Figure 15A:
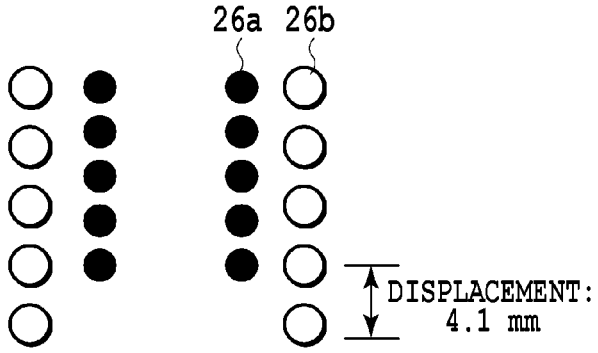
FIG. 15A is a schematic diagram illustrating the displacement of the pressing spring.
Figure 15B:
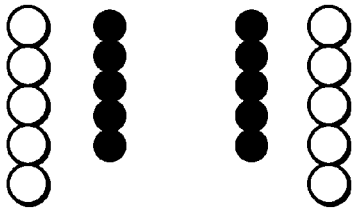
FIG. 15B is a schematic diagram illustrating the displacement of the pressing spring.

FIG. 15A and FIG. 15B are schematic diagrams illustrating the displacement of the pressure spring. As depicted in FIG. 15A and FIG. 15B, in the present embodiment, the displacement of the spring is 4.1 mm when the total of the low-pressing-force spring 26*a* and the high-pressing-force spring 26*b* is switched from 3.92 N to 11.76 N. In other words, the first flat area 17*a* is provided at a position where the first flat area 17*a* pushes in the pressing member 28 by 4.1 mm with respect to the position of the second flat area 17*b* of the downstream side support member 17. In FIG. 15A and FIG. 15B, the spring that affects the pressing force is represented by black circles, and the spring that does not affect the pressing force is represented by white circles.

That is, when the displacement is 4.1 mm, the pressing force F4 of the high-pressing-force spring 26*b* is not exerted, and only the pressing force F3 is exerted. Whereas the maximum displacement of the high-pressing-force spring 26*b* is 4.1 mm or less, the maximum displacement of the low-pressing-force spring 26*a* is more than 4.1 mm. Thus, the first flat area 17*a* is placed to press the pressing member 28 at the cutting start point P2 where the cutter unit 12 starts cutting the rolled paper 1. The second flat area 17*b* is placed at a position opposite to the pressing member 28 after the cutter unit 12 passes through the cutting start point P2. This enables a change in the pressing force F exerted by the upper movable blade 13*a* on the lower movable blade 13*b* in the process of the cutting.

As described above, the cutting apparatus of the present embodiment has the pressing force changing device that switches the pressing force F exerted on the lower movable blade 13*b* by the upper movable blade 13*a* while the cut medium is being cut. In the pressing force changing device, the downstream side support member 17 includes the first flat area 17*a* and the second flat area 17*b* retracted downstream in the paper conveying direction with respect to the first flat area 17*a*. Thus, before the start of the cutting by the cutter unit 12 and at the cutting start point P2, the pressing member 28 contacts the first flat area 17*a* and is pushed upstream in the conveying direction to press the upper movable blade 13*a*, leading to an increased pressing force F. Thus, at the start of the cutting, the upper movable blade 13*a* can be allowed to bite into the cut medium without being separated from the lower movable blade 13*b*, enabling the cutting performance to be enhanced. During the cutting, when the pressing member 28 reaches the second flat area 17*b* through the slope portion 17*c*, the pressing member 28 is slid downstream in the conveying direction to reduce the pressing force, allowing the wear of the cutting edges to be suppressed.

In the present embodiment, a plurality of springs is arranged to overlap concentrically to allow the pressing force to be changed with a small displacement of the springs.

Third Embodiment

A third embodiment will be described below with reference to the drawings. A basic configuration of the present embodiment is similar to the basic configuration of the first embodiment, and only a characteristic part of the configuration will be described below. In the present embodiment, the sliding distance of the pressing member 28, which is the pressing force changing device for the start of the cutting, is freely switched to change the pressing force exerted at the start of the cutting, in stages. The same components as those of the first and second embodiments are denoted by the same reference numerals and will not be described below.

Figure 16A:
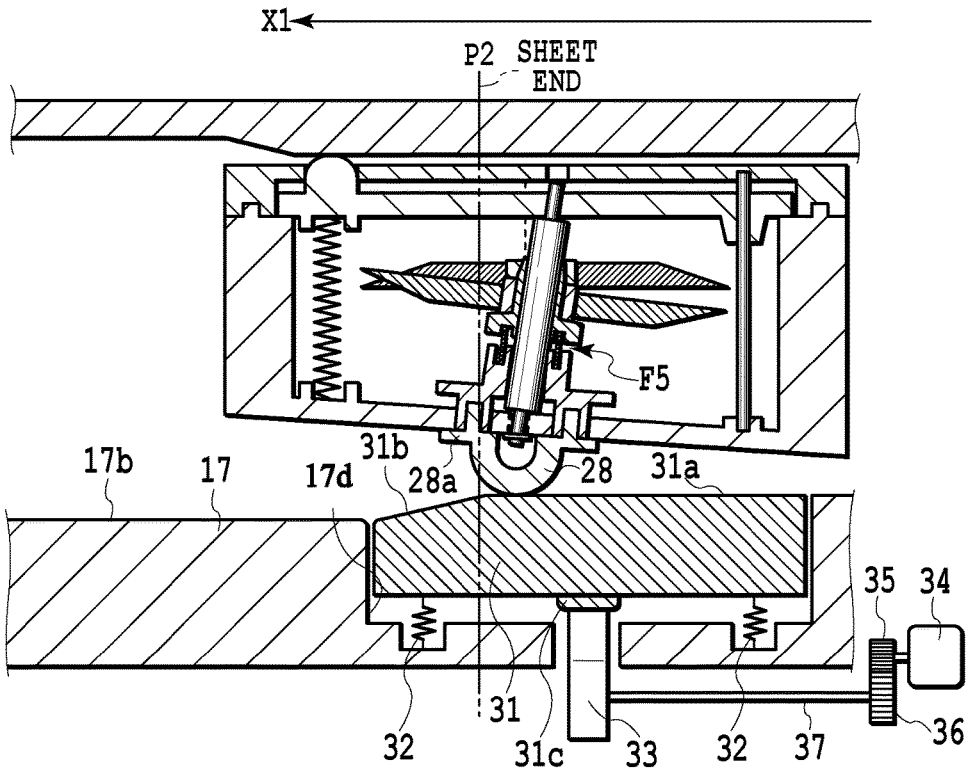
FIG. 16A is a diagram depicting a pressing force changing device.
Figure 16B:
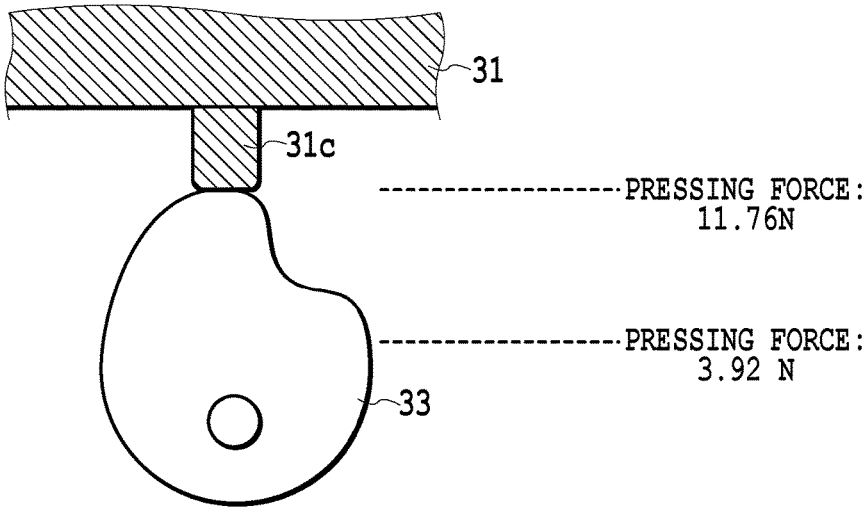
FIG. 16B is a diagram depicting the pressing force changing device.

FIG. 16A and FIG. 16B are diagrams depicting the pressing force changing device of the present embodiment. FIG. 16A is a schematic sectional view of the cutter unit exerting a pressing force at the first stage. FIG. 16B is a side view of a cam.

In the present embodiment, the pressing force exerted on the lower movable blade 13*b* by the upper movable blade 13*a* at the start of the cutting can be changed in stages. In other words, the wear of the cutting edges progresses as the cutting continues. Thus, the pressing force exerted at the start of the cutting is changed according to the degree of progress of the wear of the cutting edges to allow the cutting performance to be enhanced, while suppressing the wear of the cutting edges. The pressing force changing device that changes the pressing force in stages will be described.

(Pressing Force in the First Stage)

In the present embodiment, a groove portion 17*d* is formed in the downstream side support member 17, and a movable member 31 that is slidable in the sheet conveying direction is formed in the groove portion 17*d*, as depicted in FIG. 16A. The movable member 31 has a first flat area 31*a* and a slope portion 31*b*. A tension spring 32 is provided between a bottom surface of the groove portion 17*d* and the movable member 31 and is held by the downstream side support member 17 and the movable member 31. The movable member 31 is biased by the tension spring 32 so as to allow the first flat area 31*a* to protrude to the degree that the thrust suppressing portion 28*a* of the pressing member 28 is pushed close to a position where the thrust suppressing portion 28*a* comes into contact with the downstream side holding portion 21. FIG. 16A depicts two tension springs 32, but the number of tension springs 32 is not limited to this as long as the tension springs 32 can stably bias the movable member 31. The tension spring 32 includes one or more springs.

The movable member 31 can be slid in the sheet conveying direction by rotational driving by a cam 33 that comes into contact with a protruding portion 31*c* of the movable member 31. The cam 33 can be rotationally driven by transmitting a driving force from a driving motor 34 to the cam 33 via a first gear 35, a second gear 36, and a driving shaft 37. At the start of the cutting or during the cutting, the driving motor 34 is excited to prevent a situation where the cam 33 is unintentionally rotated to slide the movable member 31 to switch the pressing force.

As depicted in FIG. 16B, the cam 33, which comes into contact with the protruding portion 31*c* of the movable member 31 is rotationally driven such that the thrust suppressing portion 28*a* of the pressing member 28 causes the first flat area 31*a* to push the pressing member 28 close to the position where the thrust suppressing portion 28*a* of the pressing member 28 comes into contact with the downstream side holding portion 21. That is, as depicted in FIG. 16B, the cam 33 acts to set the contact surface between the protruding portion 31*c* and the cam 33 at a position where the pressing force is 11.76 N. Thus, at the first stage, the first flat area 31*a* is placed at a position where the pressure spring 25 exerts a pressing force F5 of 11.76 N. In other words, at the first stage, the upper movable blade 13*a* presses the lower movable blade 13*b* at a pressing force of 11.76 N at the cutting start position.

(Pressing Force at the Second Stage)

Figure 17A:
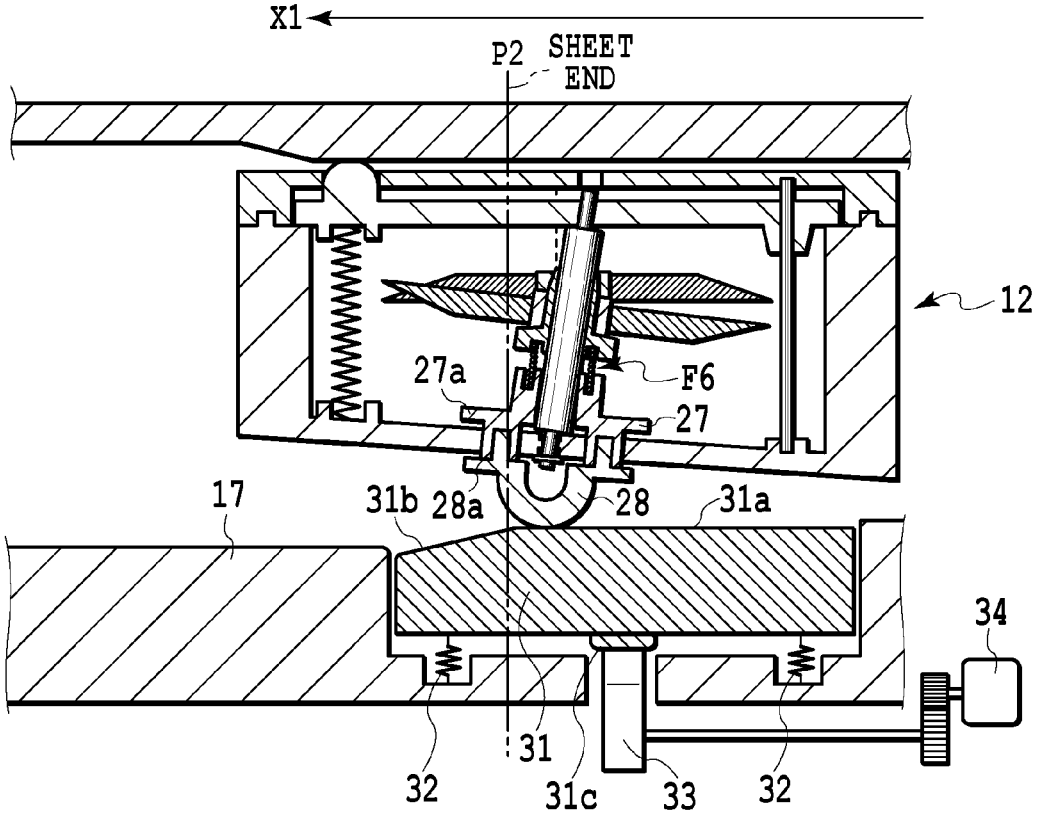
FIG. 17A is a diagram depicting a pressing force changing device.
Figure 17B:
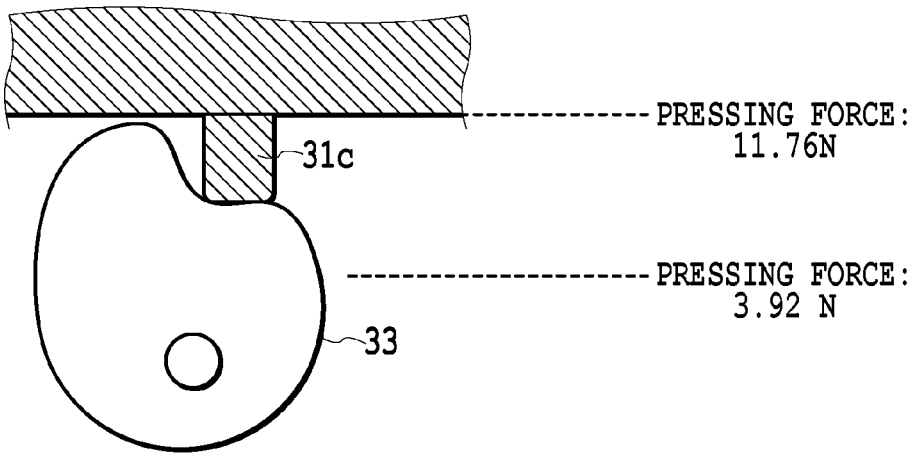
FIG. 17B is a diagram depicting the pressing force changing device.

FIG. 17A and FIG. 17B are diagrams of the pressing force changing device of the embodiment. FIG. 17A is a schematic sectional view of the cutter unit exerting a pressing force at the second stage as seen from above. FIG. 17B is a side view of the cam. As depicted in FIG. 17B, the pressing force at the second stage causes the first flat area 31*a* to push the pressing member 28 to a position where the thrust suppressing portion 28*a* of the pressing member 28 does not come into in abutting contact with the downstream side holding portion 21 and the thrust suppressing portion 27*a* of the external holder 27 does not come in abutting contact with the downstream side holding portion 21. The cam 33, which comes into abutting contact with the protruding portion 31*c* of the movable member 31, is rotationally driven to place the first flat area 31*a* at a position where the pressing member 28 is pushed in.

That is, as depicted in FIG. 17B, the cam 33 acts to set the contact surface between the protruding portion 31*c* of the movable member 31 and the cam 33 at a position where the pressing force has any value between 3.92 N and 11.76 N. Thus, the first flat area 31*a* is placed at a position where the pressure spring 25 exerts a pressing force F6 of any value between 3.92 N and 11.76 N. In other words, at the second stage, the upper movable blade 13*a* presses the lower movable blade 13*b* at a pressing force of any value between 3.92 N and 11.76 N at the cutting start position.

At this time, a step is formed between the slope portion 31*b* of the movable member 31 and the second flat area 17*b* of the downstream side support member 17 as depicted in FIG. 17A. After the start of the cutting, the second flat area 17*b* is retracted such that, with the thrust suppressing portion 27*a* of the external holder 27 in contact with the downstream side holding portion 21, the pressing member 28 does not to come into contact with the second flat area 17*b*, preventing the pressing member 28 from being affected by the step.

(Pressing Force at the Third Stage)

Figure 18A:
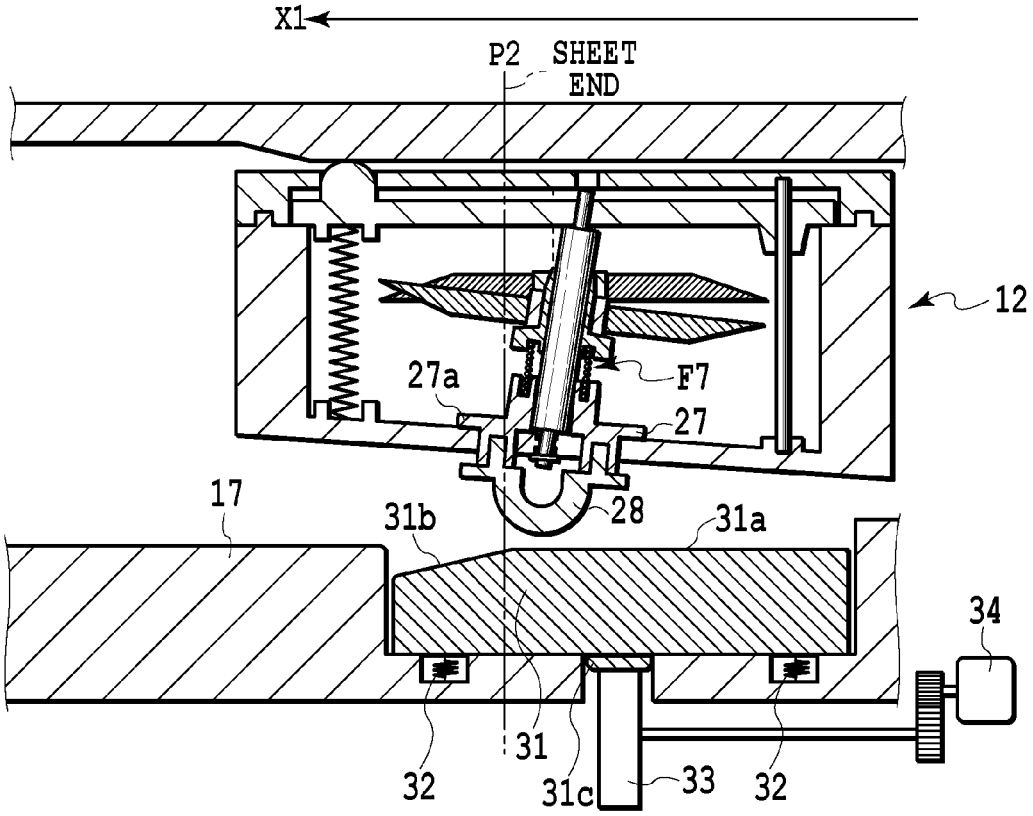
FIG. 18A is a diagram depicting a pressing force changing device.
Figure 18B:
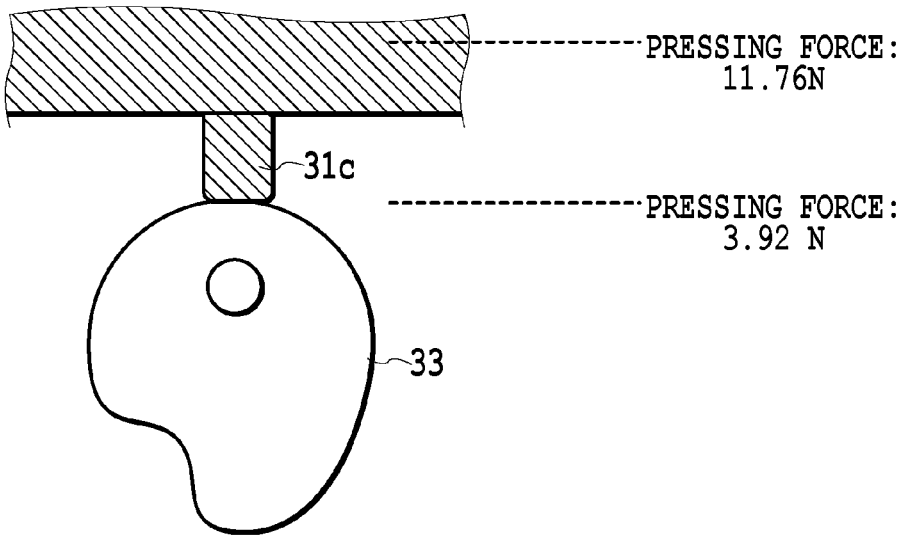
FIG. 18B is a diagram depicting the pressing force changing device.

FIG. 18A and FIG. 18B are diagrams of the pressing force changing device of the embodiment. FIG. 18A is a schematic sectional view of the cutter unit exerting a pressing force at the third stage as seen from above. FIG. 18B is a side view of the cam. As depicted in FIG. 18A, the cam 33, which comes into abutting contact with the protruding portion 31*c* of the movable member 31, is rotationally driven to move the first flat area 31*a* to a position where, with the thrust suppressing portion 27*a* of the external holder 27 in abutting contact with the downstream side holding portion 21, the pressing member 28 does not come into contact with the first flat area 31*a*.

That is, as depicted in FIG. 18A and FIG. 18B, the cam 33 acts to set the contact surface between the protruding portion 31*c* of the movable member 31 and the cam 33 at a position where the pressing force is 3.92 N. Thus, the first flat area 31*a* is placed at a position where the pressure spring 25 exerts a pressing force F7 of 3.92 N. In other words, at the third stage, the upper movable blade 13*a* presses the lower movable blade 13*b* at a pressing force of 3.92 N at the cutting start position.

In this manner, the present embodiment allows the pressing force exerted on the lower movable blade 13*b* by the upper movable blade 13*a* to be switched among the three stages. Thus, as the wear of the blades progresses, the pressing force was increased in stages to successfully enhance the cutting performance, while suppressing the wear of the cutting edges.

In the present embodiment, the configuration in which the pressing force is switched among the three stages has been described. However, the present embodiment is not limited to the configuration. For example, the pressing force may be switched among a plurality of stages according to the object to cut.

The cutting apparatus in the aspect of the present invention allows the cutting performance at the start of the cutting to be enhanced, while suppressing the wear of the cutting edges.

Other Embodiments

In the above-described embodiments, after the cutting point 15 of the cutter unit 12 passes through the cutting start point P2 and then moves a predetermined distance (the distance corresponding to one rotation of the upper movable blade 13*a* following the start of the cutting), the contact portion 22*b* is placed in the position corresponding to the slope portion 16*c*, and the pressing member 28 is placed in the position corresponding to the slope portion 16*c*. However, the present invention is not limited to this embodiment. A timing when the contact portion 22*b* reaches the slope portion 16*c* may be different from a timing when the pressing member 28 reaches the slope portion 16*c*.

For the configurations of the above-described embodiments, the serial ink jet printing apparatus has been described. However, the embodiments are applicable to what is called a line head printing apparatus in which nozzles in a print head are arranged in juxtaposition in a direction orthogonal to the sheet conveying direction (sheet width direction). Furthermore, the printing scheme is not limited to image printing based on the ink jet scheme using a liquid ink for image printing. A solid ink may be used as a print agent, and various schemes such as an electrophotographic scheme using toner and a sublimation scheme may be adopted. Additionally, the present invention is not limited to color printing using print agents in a plurality of colors, but monochrome printing using only black (including gray) may be performed.

In the above-described embodiments, the printing apparatus with the cutting apparatus has been described. However, the embodiments can also be applied to a configuration only with the cutting apparatus.

The cutter unit in which the upper movable blade and the lower movable blade are circular blades has been described. However, the present invention is applicable to a cutter unit including a circular blade and an elongate fixed blade and in which the peripheral speed of the circular blade is changed.

Even when the cutter unit uses knife-shaped blades, the pressing force exerted on the cut medium by the cutting edges of the blade members can be switched using a configuration that switches the pressing force of the cutter unit.

The configuration that cuts the cut medium by moving the cutter unit has been described. However, the present invention is applicable to a cutting apparatus configured to cut the cut medium by moving the cut medium instead of moving the cutter unit.

Besides paper, plastic sheets, photographic printing paper, cloths, and the like, a variety of sheet-like materials may be used as cut media. In the above description, the rolled paper has been taken as an example of the cut medium cut by the cutting apparatus. However, the present invention is not limited to rolled cut media. Continuous sheets that are not rolled and the like may be used, and any media that can be cut by the cutting apparatus may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-183375, filed Sep. 9, 2014, which is hereby incorporated by reference herein in its entirety.

What is claimed is:

1. A cutting apparatus comprising:

a cutting unit including a first blade member, and a second blade member that cooperates with the first blade member in cutting an object, the cutting unit configured to cut the object by moving the object and at least one of the first blade member and the second blade member relative to each other to cut the object; and a changing unit configured to change a pressing force between the first blade member and the second blade member during an operation of cutting the object;

wherein the changing unit changes the pressing force so that the pressing force during a first cutting operation, in which the cutting unit moves a predetermined distance from an end of the object to cut the object, is higher than the pressing force during a second cutting operation, in which the cutting unit moves further from the predetermined distance to further cut the object.

2. The cutting apparatus according to claim 1, wherein the changing unit changes the pressing force during the first cutting operation to one of a plurality of different pressing forces.

3. The cutting apparatus according to claim 1, wherein the changing unit changes the pressing force exerted on the second blade member by the first blade member.

4. The cutting apparatus according to claim 1, wherein each of the first blade member and the second blade member is a circular blade member that is provided so as to be rotatable and that includes a peripheral blade.

5. The cutting apparatus according to claim 1, further comprising a spring, wherein the changing unit changes a pressing force of the first blade member on the second blade member using a bias force of the spring.

6. The cutting apparatus according to claim 5, wherein the spring is comprised of a plurality of springs with different maximum displacements.

7. The cutting apparatus according to claim 1, further comprising a support unit, wherein the cutting apparatus cuts the object by moving the cutting unit along the support unit, the support unit includes a protruding portion, the changing unit has a pressing member that protrudes to a surface of the support unit that includes the protruding portion, and the changing unit changes the pressing force according to a change in a state of contact between the support unit and the pressing member in conjunction with movement of the cutting portion.

8. The cutting apparatus according to claim 7, wherein the protruding portion of the support unit is configured to enable a protruding distance to be changed.

9. The cutting apparatus according to claim 8, wherein the protruding portion of the support unit is configured to enable the protruding distance to be changed using a cam.

10. The cutting apparatus according to claim 9, wherein the protruding distance of the protruding portion is able to be changed among a plurality of stages.

11. A printing apparatus comprising:

an image printing unit configured to print an image on an object;

a cutting unit including a first blade member, and a second blade member that cooperates with the first blade member in cutting an object, the cutting unit configured to cut the object by moving the object and at least one of the first blade member and the second blade member relative to each other to cut the object; and a changing unit configured to change a pressing force between the first blade member and the second blade member during an operation of cutting the object, wherein the changing unit changes the pressing force so that the pressing force during a first cutting operation, in which the cutting unit moves a predetermined distance from an end of the object to cut the object, is higher than the pressing force during a second cutting operation, in which the cutting unit moves further from the predetermined distance to further cut the object.

* * * * *